US009855639B2

(12) United States Patent
Klett et al.

(10) Patent No.: US 9,855,639 B2
(45) Date of Patent: Jan. 2, 2018

(54) ABRASIVE ARTICLE

(71) Applicants: SAINT-GOBAIN ABRASIVES, INC., Worcester, MA (US); SAINT-GOBAIN ABRASIFS, Conflans-Sainte-Honorine (FR)

(72) Inventors: Michael W. Klett, Holden, MA (US); Frank J. Csillag, Hopkinton, MA (US); Tyler B. Cichowlas, Sudbury, MA (US); Davinder S. Dhami, Millbury, MA (US); Lawrence J. Lavallee, Jr., Auburn, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 151 days.

(21) Appl. No.: 14/317,340

(22) Filed: Jun. 27, 2014

(65) Prior Publication Data

US 2015/0000206 A1 Jan. 1, 2015

Related U.S. Application Data

(60) Provisional application No. 61/840,902, filed on Jun. 28, 2013, provisional application No. 61/840,906,
(Continued)

(51) Int. Cl.
*B24D 3/28* (2006.01)
*B24D 3/22* (2006.01)
(Continued)

(52) U.S. Cl.
CPC ..... *B24D 3/28* (2013.01); *B24D 3/22* (2013.01); *B24D 5/04* (2013.01); *B24D 5/14* (2013.01);
(Continued)

(58) Field of Classification Search
CPC ..... C09K 3/14; C09K 3/1409; C09K 3/1436; C09K 3/1463; B24D 3/00; B24D 11/00;
(Continued)

(56) References Cited

U.S. PATENT DOCUMENTS 3,030,743 A 4/1962 Albert
3,838,543 A 10/1974 Lakhani
(Continued)

FOREIGN PATENT DOCUMENTS

CN 1114670 A 1/1996
CN 101817171 A 9/2010
(Continued)

OTHER PUBLICATIONS

U.S. Appl. No. 14/317,117, filed Jun. 27, 2014, Inventors: Michael W. Klett, et al.
(Continued)

*Primary Examiner* — Jennifer A Smith
*Assistant Examiner* — Alexandra M Moore
(74) *Attorney, Agent, or Firm* — Abel Law Group, LLP; Thomas Osborn

(57) ABSTRACT

An abrasive article has an abrasive portion with an organic bond and abrasive particles. The abrasive article has a non-abrasive portion (NAP) mounted to the abrasive portion. The NAP includes molding compound (MC) having chopped strand fibers (CSF). The CSF can be coated with a thermoplastic coating having a loss on ignition (LOI) of at least about 2.4 wt %, and the NAP having no abrasive particles. The NAP can include an MC having no abrasive particles with a MOHS scale hardness of at least about 9. The NAP may include CSF coated with a primary coating and a secondary coating on the primary coating. The NAP may have an outer diameter that is at least half of but not greater than an outer diameter of the abrasive article.

20 Claims, 16 Drawing Sheets

Related U.S. Application Data filed on Jun. 28, 2013, provisional application No. 61/840,919, filed on Jun. 28, 2013, provisional application No. 61/840,933, filed on Jun. 28, 2013, provisional application No. 61/841,052, filed on Jun. 28, 2013.

(51) Int. Cl.

| | |
|---|---|
| ***B24D 18/00*** | (2006.01) |
| ***B24D 5/04*** | (2006.01) |
| ***B24D 5/14*** | (2006.01) |
| ***B24D 5/16*** | (2006.01) |
| ***B24D 7/04*** | (2006.01) |
| ***B24D 7/14*** | (2006.01) |
| ***B24D 7/16*** | (2006.01) |
| ***B24D 11/02*** | (2006.01) |

(52) U.S. Cl.

CPC ..... *B24D 5/16* (2013.01); *B24D 7/04* (2013.01); *B24D 7/14* (2013.01); *B24D 7/16* (2013.01); *B24D 11/02* (2013.01); *B24D 18/0009* (2013.01)

(58) Field of Classification Search

CPC ..... B24D 7/00; B24D 18/00; B24B 37/24; E21B 10/00

See application file for complete search history.

(56) References Cited

U.S. PATENT DOCUMENTS

| | | | | |
|---|---|---|---|---|
| 4,918,116 | A | 4/1990 | Gardziella et al. | |
| 5,611,827 | A | 3/1997 | Hammarstrom et al. | |
| 5,861,203 | A | 1/1999 | Yuan et al. | |
| 6,299,508 | B1 | 10/2001 | Gagliardi et al. | |
| 6,419,981 | B1 | 7/2002 | Bruce et al. | |
| 6,749,496 | B2 | 6/2004 | Mota | |
| 6,846,573 | B2 | 1/2005 | Seydel | |
| 6,942,561 | B2 | 9/2005 | Mota | |
| 8,961,269 | B2 | 2/2015 | Han et al. | |
| 2002/0184829 | A1 | 12/2002 | Lemberger et al. | |
| 2005/0025967 | A1 | 2/2005 | Lawton et al. | |
| 2005/0266221 | A1* | 12/2005 | Karam | B32B 5/28 428/292.1 |
| 2008/0143010 | A1 | 6/2008 | Sanjay et al. | |
| 2010/0159806 | A1 | 6/2010 | Wu et al. | |
| 2010/0180512 | A1* | 7/2010 | Arnaud | B24D 3/34 51/298 |
| 2010/0190424 | A1* | 7/2010 | Francois | B24D 5/123 451/548 |
| 2012/0100784 | A1* | 4/2012 | Klett | B24D 3/342 451/41 |
| 2012/0289125 | A1 | 11/2012 | Billig et al. | |
| 2012/0297693 | A1 | 11/2012 | Zuyev et al. | |

FOREIGN PATENT DOCUMENTS

| | | | |
|---|---|---|---|
| CN | 202726754 | U | 2/2013 |
| EP | 0577805 | B1 | 3/1997 |
| EP | 0739264 | B1 | 8/1998 |
| EP | 0997231 | A2 | 5/2000 |
| EP | 0842013 | B1 | 8/2000 |
| EP | 1259355 | A1 | 11/2002 |
| EP | 0789641 | B1 | 2/2005 |
| EP | 0874717 | B1 | 8/2005 |
| EP | 1395395 | B1 | 10/2005 |
| EP | 0988341 | B1 | 5/2006 |
| EP | 1907476 | A1 | 4/2008 |
| EP | 1968476 | A1 | 9/2008 |
| EP | 2059368 | A1 | 5/2009 |
| EP | 2237924 | A1 | 10/2010 |
| EP | 1954445 | B1 | 6/2015 |
| GB | 2028860 | A | 3/1980 |
| JP | 2003-311630 | A | 11/2003 |
| WO | 95-20469 | A1 | 8/1995 |
| WO | 9855545 | A1 | 12/1998 |
| WO | 2007005452 | A1 | 1/2007 |
| WO | 2007079168 | A1 | 7/2007 |
| WO | 2008034056 | A1 | 3/2008 |
| WO | 2009079639 | A1 | 6/2009 |
| WO | 2012092610 | A1 | 7/2012 |

OTHER PUBLICATIONS

U.S. Appl. No. 14/317,163, filed Jun. 27, 2014, Inventors: Xiangbin Yu, et al.

International Search Report for PCT/US2014/044515 dated Oct. 21, 2014, 8 pgs.

International Search Report for PCT/US2014/044539 dated Oct. 28, 2014, 4 pgs.

Victor C. Li and Hwai-Chung Wu, Conditions for pseudo strain-hardening in fiber reinforced brittle matrix composites, Applied mechanics review, vol. 45,No. 8,pp. 390-398, 1991.

Victor C. Li etal, A micromechanical model of tension-softening and bridging toughening of short random fiber reinforced brittle matrix composites, Journal of the mechanics and physics in solids, vol. 39, No. 5,pp. 607-625,1991.

Victor C. Li, Postcrack scaling relations for fiber reinforced cementitious composites, Journal of materials in civil engineering, vol. 4, No. 1 pp. 41-57,1992.

Zhong Lin and Victor C. Li, Crack bridging in fiber reinforced cementitious composites with slip-hardening interfaces, Journal of the mechanics and physics in solids, vol. 45,No. 5,pp. 763-787,1997.

J.G. Williams "Chapter 4: Stress Intensity Factor Solutions", Fracture Mechanics of Polymers, p. 61-90, Halsted Press, 1984.

U.S. Appl. No. 14/317,117, filed Jun. 27, 2014.

* cited by examiner

ABRASIVE ARTICLE

This application claims priority to and the benefit of the following U.S. Provisional Patent Applications: 61/840,902, 61/840,906, 61/840,919, 61/840,933, and 61/841,052, all filed on Jun. 28, 2013, and each of which is incorporated herein by reference in its entirety.

BACKGROUND OF THE INVENTION

Field of the Disclosure

The present invention relates in general to abrasive wheels and, in particular, to a system, method and apparatus for abrasive articles having improved fracture properties and grinding performance.

Description of the Related Art

Phenolic-based grinding wheels are made by sequentially charging into a mold layers of an abrasive mix and fiber glass web reinforcements, consolidating the components with pressure and then subsequently curing in an oven at elevated temperatures. In some cases the composition of the abrasive mix in the multilayered wheels may be different. These compositional differences in the layers are used to provide advantages in either or both performance and economics. Both single and double layered wheel compositions are conducive to high through-put manufacturing processes such as the shuttle box presses. Incorporation of compositional variations within the core of the wheel could provide additional economic and strength advantages. The process for incorporating a core having a composition other than that of the grinding zone requires additional and specialized equipment such as a containment ring of specific diameter and height that allows filling of the core with a distinctively different abrasive mix composition. Once the core is filled to the desired level with the abrasive mix, the containment ring is carefully removed so as not to perturb the two adjacent compositions. This operation is tricky and not conducive to high throughput wheel making.

Phenolic-based resins used to manufacture grinding wheels are inherently brittle materials that are subject to failure due to the probability of defects within the part. Reinforcements are therefore used in most wheels to preclude brittle and catastrophic failure.

One such reinforcement is a fiber glass web or fabric of various weights and styles. The webs are designed to improve the radial strength and prevent the explosive release of wheel fragments in the event that the wheel breaks during use. The web comprises a plurality of individual yarns or strands woven into a 0°/90° open structured fabric. The fabric is dipped in a phenolic resin to form a coating and subsequently dried or cured. Once the coating is cured to the desired level, the web is wound into a roll for easy storage until needed. The final step in preparing the web for use in the wheel is unwinding the roll and cutting individual circles having the desired dimensions. Significant waste is generated from cutting the appropriately shaped discs used to reinforce the wheel from the roll of web. The process is labor and time intensive, generates significant waste and is therefore expensive. Additionally, these fiber webs have a detrimental effect on grinding performance.

Chopped strand fibers also have been used to reinforce resin-based grinding wheels having a thick cross-sectional area. The chopped strand fibers are typically 3 to 4 mm in length and include a plurality of filaments. The number of filaments can vary depending on the manufacturing process but typically consists of 400 to 6000 filaments per bundle. The filaments are held together by an adhesive known as a sizing, binder, or coating that should ultimately be compatible with the resin matrix. The sizing comprises less than 2 wt % of the reinforcement. The amount of sizing or coating is limited by the current manufacturing processes used to make direct sized yarn or chopped strand products. One example of a chopped strand fiber is referred to as 174, available from Owens Corning.

Incorporation of chopped strand fibers into a dry grinding wheel mix is generally accomplished by blending the chopped strand fibers, resin, fillers, and abrasive particles for a specified time and then molding, curing, or otherwise processing the mix into a finished grinding wheel. High levels of chopped strands fibers in these mixes are inherently difficult to transfer into the mold and level or spread due to fiber bridging effects. Additionally, as the fiber bundles are dispersed into filaments, the bulk density decreases (volume increases) and mold filling with the correct amount of mix becomes more difficult. Chopped fibers in wheels having thin cross sections are not used because of these inherent difficulties associated transferring the mix and filling the mold.

Chopped strand fiber reinforced wheels typically suffer from a lower strength, presumably due to incomplete dispersal of the filaments within the chopped strand fiber bundle poor adhesion with the matrix resin, fiber length degradation, or a combination thereof.

There is therefore a need to be able to make multi-compositional zoned wheels with improved reinforcements using the shuttle-box process that can provide higher strength and higher fracture toughness without compromising grinding performance.

SUMMARY

Embodiments of abrasive articles and their methods of fabrication are disclosed. For example, an abrasive article may include an abrasive portion comprising an organic bond and abrasive particles. The abrasive article may further include a non-abrasive portion (NAP) coupled to the abrasive portion. The NAP may include molding compound (MC) having no abrasive particles with a MOHS scale hardness greater than about 9.

In other embodiments, a method of fabricating an abrasive article may include forming a molding compound (MC) that is non-abrasive and uncured, wherein the MC comprises a thermosetting phenolic material with a room temperature viscosity of 1 to 2 million pascal-sec, and 0.05 to 0.2 pascal-sec at 100° C., and subsequently cures reaching a maximum viscosity above 125° C.; forming an abrasive matrix comprising an organic bond and abrasive particles; sequentially transferring the MC and the abrasive matrix into a mold; and then pressurizing the MC and abrasive matrix to conform to the mold and form the abrasive article.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
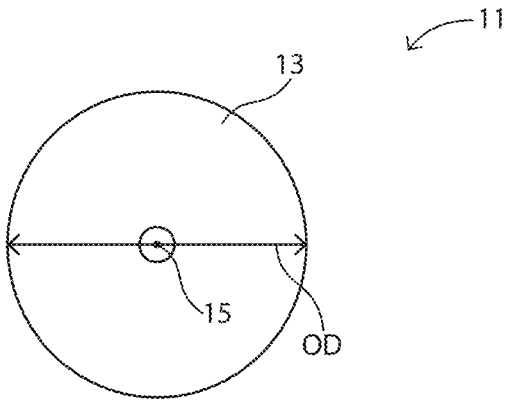
FIGS. 1 and 2 are schematic side and edge views of an embodiment of an abrasive article.

Embodiments of a system, method and apparatus for grinding wheels reinforced by discontinuous fibers are disclosed. For example, an abrasive article 11 (FIGS. 1 and 2) may comprise an abrasive body 13 having an axis 15. In some versions, the abrasive body 13 may have an outer diameter (OD) and an axial thickness (AT).

Figure 3A:
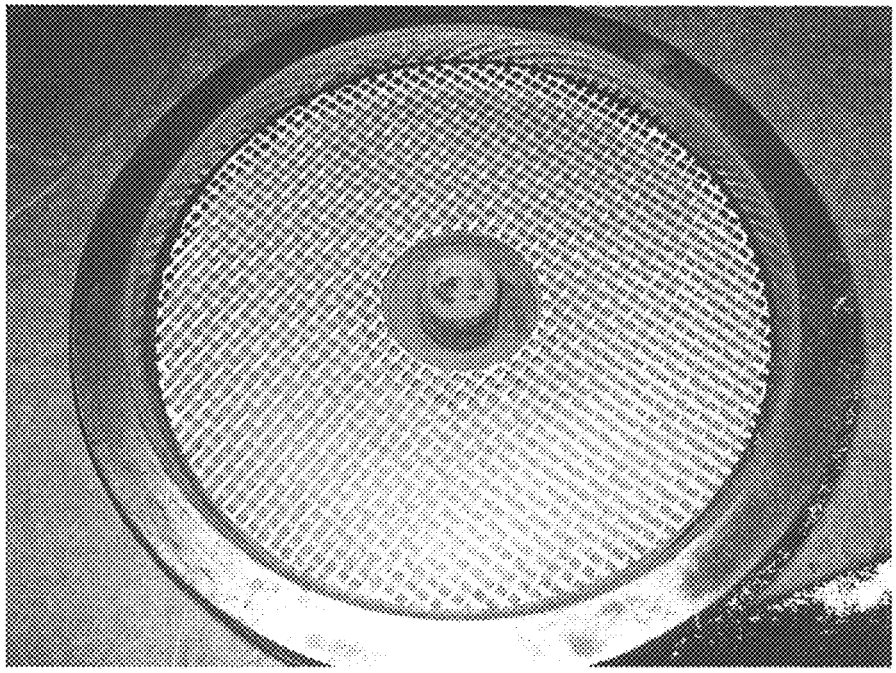
FIGS. 3A and 3B are images of conventional and CSF wheel subassemblies, respectively.
Figure 3B:
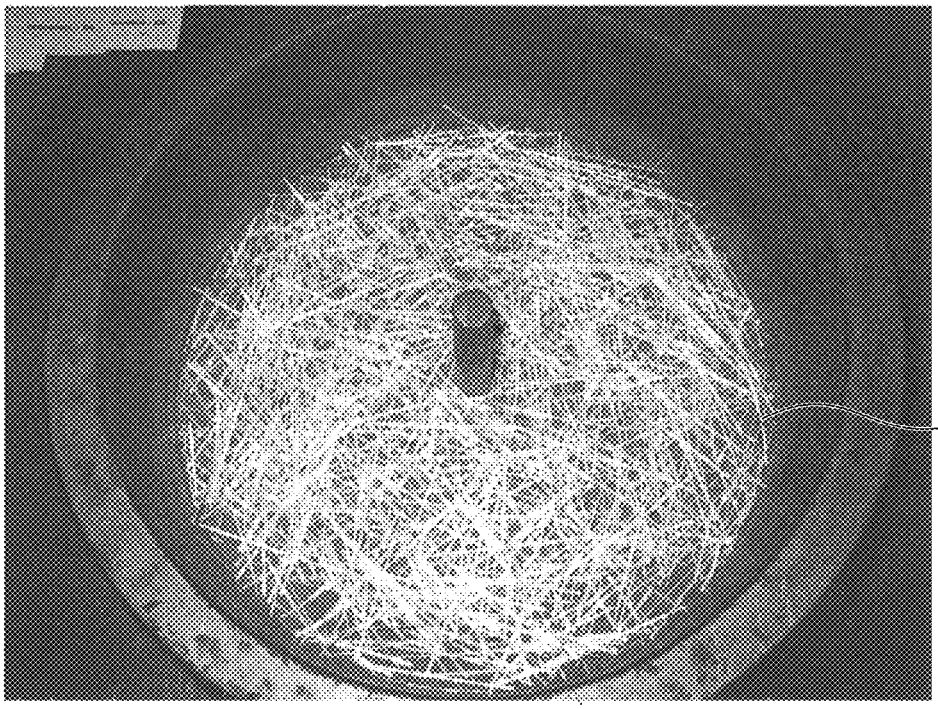

Embodiments of the abrasive body 13 may comprise an abrasive mix 17 comprising an organic bond and abrasive particles. The abrasive body may further comprise a reinforcement 19 comprising discontinuous fibers 21 (FIG. 3B). For example, the discontinuous fibers 21 may comprise chopped strand fibers (CSF).

Figure 4:
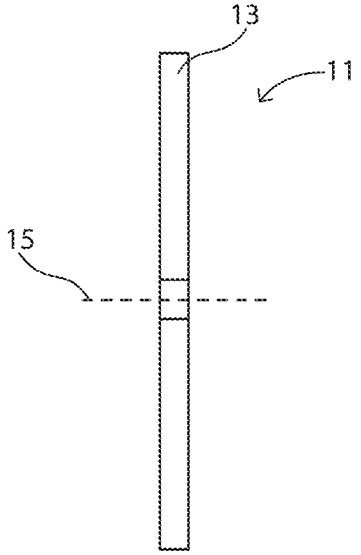
FIGS. 4-6 are edge views of alternate embodiments of abrasive articles.

The discontinuous fibers 21 may be dispersed in the abrasive body 13 (FIG. 4). In one example, the discontinuous fibers 21 may be dispersed throughout the abrasive body 13, such that the discontinuous fibers 21 are substantially randomly distributed throughout the abrasive body 13 and do not form a separate layer.

Figure 2:
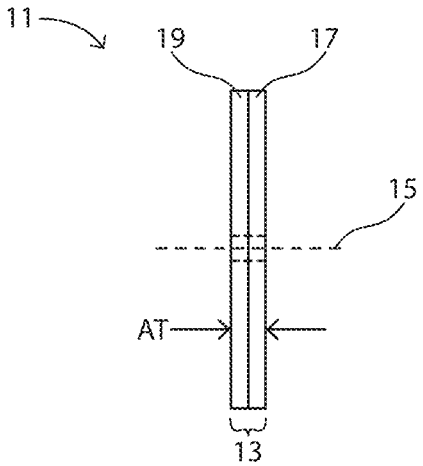

As depicted in FIGS. 2 and 3B, the discontinuous fibers 21 also may be formed as part of a discrete layer or as a discrete layer 19. For example, the discontinuous fibers 21 may comprise a pre-formed chopped strand fiber mat. Alternatively, the fibers may be chopped directly into a mold, or pre-chopped and then added to the mold. The abrasive article 11 may comprise an abrasive portion 13 comprising an organic bond material and abrasive particles dispersed in the organic bond material. A discrete layer 19 of chopped strand fibers (CSF) may be located at least partially in the organic bond material and coupled (e.g., chemically and mechanically bonded) to the abrasive portion 13 for reinforcement thereof. In some versions, the discrete layer can be a sintered mat of the CSF such that the CSF are integral.

Figure 5:
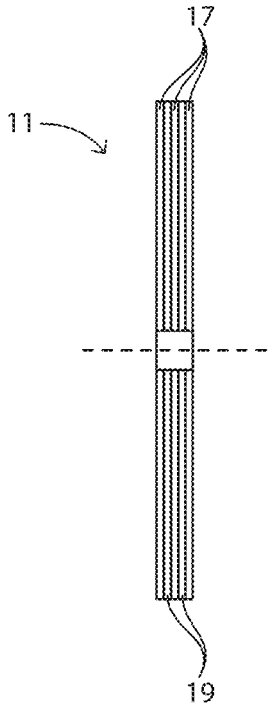

In other examples, the discrete layer 19 may comprise a plurality of discrete layers 19 (FIG. 5) that are axially separated from each other by portions or layers of the abrasive mix 17. The abrasive portion 17 may comprise at least two abrasive layers, such that one or more discrete layers 19 are located and extend axially between said at least two abrasive layers.

Figure 6:
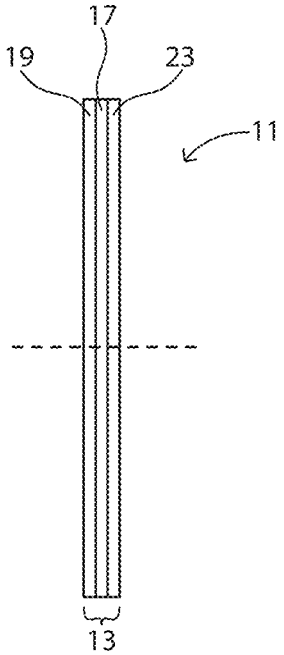

In some versions, the abrasive body 13 does not have a continuous fiber reinforcement web, such that the abrasive body 13 is reinforced only by the discontinuous fibers 21. Other versions of the abrasive article 11 may further comprise at least one continuous fiber reinforcement web 23 (FIG. 6) in the abrasive body 13, such that the abrasive body 13 is reinforced by the discontinuous fibers 21 and the continuous fiber reinforcement web 23.

Figure 7:
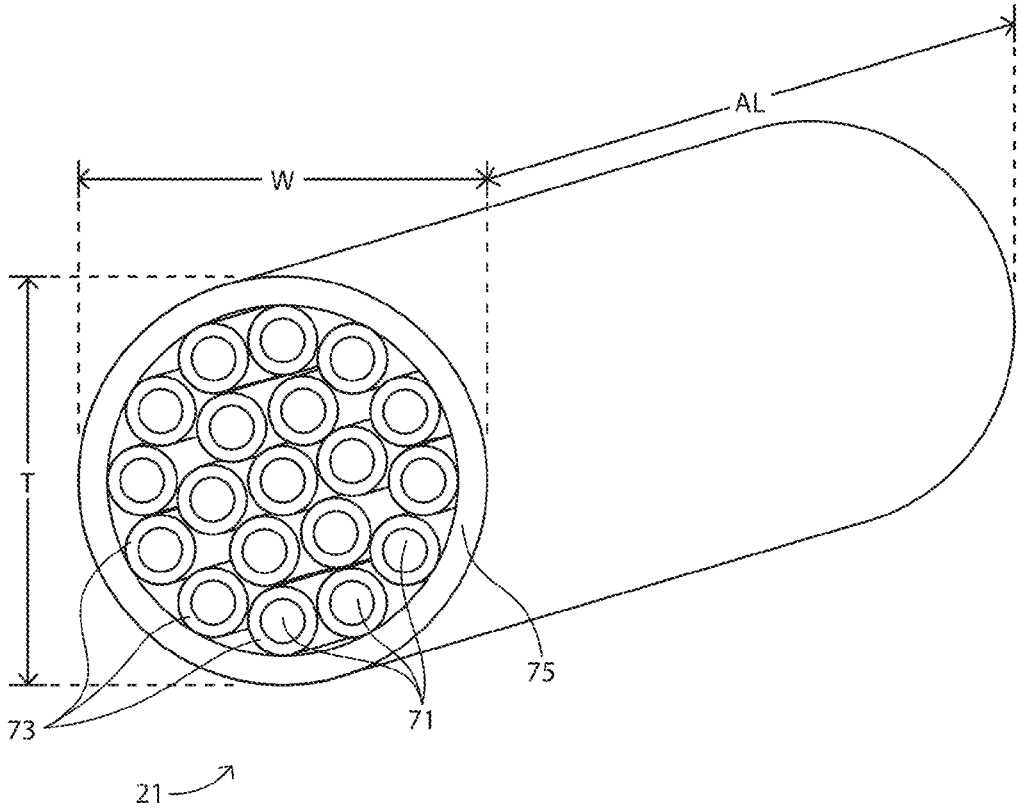
FIG. 7 is a schematic isometric view of an embodiment of strand of discontinuous fibers.

FIG. 7 schematically illustrates an embodiment of a strand of discontinuous fibers 21. In reality, the shapes, numbers and relative sizes of the strand, filaments and coatings can vary, depending on the application. The strand may comprise a substantially cylindrical or rounded sectional shape, such as oval or elliptical shapes. The strand may include individual filaments 71. Each individual filament may include a coating 73, such as a primary coating, described elsewhere herein. Collectively, the strand of coated individually coated filaments 71 may include a secondary coating 75, as shown and described elsewhere herein.

The strand of discontinuous fibers 21 may include a sectional aspect ratio of width W to thickness T. The sectional aspect ratio can be in a range of about 1:1 to about 3:1. For example, the sectional aspect ratio may be about 1.75:1 to about 2.75:1, or even about 2:1 to about 2.5:1.

In some embodiments, the strand of discontinuous fibers 21 may comprise a width W (e.g., a radial width) of at least about 0.1 mm. For example, the radial width may be at least about 0.2 mm, such as at least about 0.3 mm. In other versions, the radial width can be not greater than about 0.5 mm, such as not greater than about 0.4 mm, not greater than about 0.3 mm, or even not greater than about 0.2 mm. The width may be in a range between any of the minimum and maximum values.

Embodiments of the strand of discontinuous fibers 21 may comprise an axial length AL of at least about 6 mm. In other versions, the AL may be at least about 7 mm, such as at least about 8 mm, at least about 10 mm, at least about 15 mm, or even at least about 20 mm. Still other versions of the AL can be not greater than about 150 mm, such as not greater than about 100 mm, not greater than about 75 mm, not greater than about 50 mm, not greater than about 40 mm, or even not greater than about 30 mm. The AL may be in a range between any of these minimum and maximum values.

Embodiments of the strand of discontinuous fibers 21 may have an aspect ratio of axial length AL to radial width W of at least about 10. For example, the aspect ratio may be at least about 12, such as at least about 25, such as at least about 50, at least about 75, at least about 100, at least about 250, or even at least about 500. In other versions, the aspect ratio can be not greater than about 1500, such as not greater than about 1000, not greater than about 750, not greater than about 500, not greater than about 250, not greater than about 200, or even not greater than about 150. The aspect ratio may be in a range between any of these minimum and maximum values.

In one example, the abrasive articles may include a thermosetting phenolic resin and reinforcing fillers having an aspect ratio (l/d) equal to or greater than about 10.

Embodiments of the abrasive body 13 may comprise a volume percentage of the discontinuous fibers 21 of at least about 1 vol %. For example, the volume percentage of the discontinuous fibers can be at least about 2 vol %, such as at least about 3 vol %, at least about 4 vol %, at least about 5 vol %, at least about 6 vol %, or even at least about 9 vol %. In other versions, the volume percentage of the discontinuous fibers can be not greater than about 25 vol %, such as not greater than about 20 vol %, or even not greater than about 15 vol %. The volume percentage of the discontinuous fibers can be in a range between any of these minimum and maximum values.

In other examples, the abrasive article can comprise about 25 vol % to about 50 vol % of the organic bond material. In another example, the abrasive article can comprise about 40 vol % to about 70 vol % of the abrasive particles. In still another example, the abrasive article can comprise about 6 vol % to about 12 vol % of the discontinuous fibers.

Other embodiments of an abrasive article may comprise a reinforcement in the abrasive article. For example, the reinforcement can comprise CSF coated with a coating. The coating can be cross-linked, such as at a low level. In other versions, less than about 10%, or even less than about 5% of the coating can be cross-linked. The coating may include a thermoplastic coating. The thermoplastic coating may comprise a high hydrogen-bonding capacity. For example, a thermoplastic polymer -(A-B)— made with monomers A and B, where the B segment of the polymer contains at least one XHn functionalities, where X=O or N or S, and n=1 or 2. The coating may comprise one or more of a thermoplastic, thermoplastic phenolic, phenoxy, polyurethane and novolac.

In another version, the thermoplastic coating may be partially crosslinked using conventional crosslinking agents. Such crosslinking agents may include hexamethylenetetramine, formaldehyde, epoxy, isocyanate, etc. The extent of crosslinking can be small, such as less than about 10% of the coating can be cross-linked.

The CSF 21 (FIG. 7) can have a primary coating 73 and a thermoplastic coating that can be a secondary coating 75 on the primary coating 73. For example, the CSF can have a direct sized coating 73, and the thermoplastic coating can be a secondary coating 75 on the direct sized coating 73. The direct sized coating can have a loss on ignition (LOI), which may be defined as the wt % of the coating relative to the total weight of the CSF. For example, the LOI can be less than about 2 wt %, such as less than or equal to about 1 wt %.

Other embodiments of the reinforcement can have a LOI of at least about 2 wt %. In some examples, the LOI can be at least about 3 wt %, such as at least about 5 wt %, at least about 7 wt %, at least about 9 wt %, at least about 12 wt %, or even at least about 15 wt %. Alternate embodiments of the LOI can be not greater than about 25 wt %, such as not greater than about 20 wt %, not greater than about 15 wt %, or even not greater than about 12 wt %. The LOI may be in a range between any of these minimum and maximum values.

Another embodiment of an abrasive article may comprise a reinforcement comprising CSF, at least some of which can have an initial length (i.e., prior to final processing of the abrasive article) of at least about 6.3 mm (0.25 inches). Alternatively, the length of the CSF can be at least about 6.3 mm, such as at least about 7 mm, at least about 8 mm, at least about 10 mm, at least about 12 mm, at least about 15 mm, or even at least about 20 mm. In other versions, the length of the CSF can be not greater than about 125 mm, such as not greater than about 100 mm, not greater than about 75 mm, not greater than about 50 mm, not greater than about 40 mm, or even not greater than about 30 mm. The CSF length may be in a range between any of these minimum and maximum values.

In some embodiments, the CSF may comprise a yield in a range of about 134 TEX (3700 yd/lb) to about 1830 TEX (271 yd/lb). In other versions, the CSF may comprise a yield of at least 125 TEX, such as at least 250 TEX, at least 500 TEX, at least 750 TEX, at least 1000 TEX, or even at least 1500 TEX. Other embodiments of the CSF may comprise a yield of not greater than about 2000 TEX, such as not greater than about 1500 TEX, not greater than about 1000 TEX, not greater than about 750 TEX, not greater than about 500 TEX, or even not greater than about 250 TEX. The yield may be in a range between any of these minimum and maximum values.

In some embodiments, the abrasive article does not have a continuous fiber reinforcement, such that the abrasive article is reinforced only by the CSF. However, in other versions, the abrasive article may further comprise at least one web formed from continuous fiber reinforcement, such that the abrasive body is reinforced by the CSF and the web.

The terms $G_{1C}$ (toughness) and work-of-fracture (wof) may be used to measure the crack initiation-energy and crack-propagation stability, respectively. The $G_{1C}$ value may be determined by measuring the point at which the crack initiates in a bar with a pre-existing flaw. The wof may be calculated by measuring the total energy it takes to propagate the crack through the entire specimen. The test employs a single-edge-notch (SEN) geometry. The width of the specimen (about 0.5"-1.5") depends on the number and spacing of the webs. A 0.14" notch may be cut along an edge of the bar with a 0.005" thick diamond wheel. The specimen thickness is 0.5", leaving a 0.36" uncracked ligament (about 0.5"-0.36"). The notched bar is placed in a 3-point bend fixture with a 2" load span. The load is applied at 0.02"/min. At the point the crack initiates, the $G_{1C}$ is calculated using a technique developed by J G Williams (*Fracture Mechanics of Polymers*, Ellis Horwood Ltd, chapter 4 (1984)). Both the $G_{1C}$ and the wof can be determined from a single specimen. After the initiation, the loading continues until the entire bar is fractured. The total integrated energy divided by the area of the original uncracked ligament is the wof.

Some embodiments of the abrasive article may be provided with a wof that is greater than that of a conventional abrasive article (CAA). For example, the wof of the abrasive article may be at least about 2% greater than that of the CAA, such as at least about 3% greater, at least about 5% greater, at least about 7% greater, or even at least about 10% greater than that of the CAA. The CAA may comprise at least one of: (a) CSF with a coating having an LOI of less than 2 wt %; (b) CSF without a secondary coating; and (d) CSF having a length of less than 6.3 mm. The wof may be in a range between any of these minimum and maximum values.

In other embodiments, the abrasive article may be compared to a CAA reinforced with a continuous fiber web and no CSF. The abrasive article may have a wof that is within about 5% of that of the CAA, such as within about 10%, or even within about 15% of that of the CAA. The wof may be in a range between any of these minimum and maximum values.

Alternate embodiments of the abrasive article also may be compared to the CAA with regard to strength (psi). For example, the abrasive article may have a strength (psi) that is within about 1% of that of the CAA, such as within about 5%, or even within about 10% of that of the CAA. The strength may be in a range between any of these minimum and maximum values.

Similarly, embodiments of the abrasive article also may be compared to the CAA with regard to toughness ($G_{1C}$). For example, the toughness ($G_{1C}$) of the abrasive article may be within about 1% of that of the CAA, such as within about 5%, or even within about 10% of that of the CAA.

In alternate embodiments, a method of fabricating an abrasive article may comprise making an abrasive mix comprising an organic bond and abrasive particles; forming the abrasive mix into a shape of an abrasive article in a mold; chopping a continuous strand yarn or roving into chopped strand fibers (CSF), at least some of which can have a length of at least about 6.3 mm; depositing the CSF in the mold with the abrasive mix; and then molding the abrasive article such that the CSF forms a reinforcement for the abrasive article.

The continuous strand yarn or roving may have a primary coating and the method may further comprise, prior to chopping, applying a secondary coating on the primary coating. In some versions, chopping may comprise chopping the CSF real time in-situ after forming and before molding.

Other embodiments of a method of fabricating an abrasive article may comprise making an abrasive portion comprising an organic bond and abrasive particles; reinforcing the abrasive article with chopped strand fibers (CSF) coated with a thermoplastic coating having a loss on ignition (LOI) of at least about 2 wt %; and molding the abrasive portion and the CSF to form the abrasive article.

Another embodiments of a method of fabricating an abrasive article may comprise making an abrasive portion comprising an organic bond and abrasive particles; reinforcing the abrasive article with chopped strand fibers (CSF) coated with a primary coating or direct sized coating, and a secondary coating on the primary coating; and molding the abrasive portion and CSF to form the abrasive article.

Still another embodiment of a method of fabricating an abrasive article may comprise making an abrasive portion comprising an organic bond and abrasive particles; reinforcing the abrasive article with chopped strand fibers (CSF) having a length of at least about 6.3 mm; and molding the abrasive portion and CSF to form the abrasive article.

In some versions of the method, the CSF may be provided as a continuous strand yarn or roving, and the method may further comprise chopping the continuous strand yarn or roving into CSF after making the abrasive portion and before molding. In other versions of the method, reinforcing may comprise mixing the CSF in at least a portion of the abrasive article such that the CSF are distributed within the abrasive article. In still another version of the method, reinforcing may comprise placing a layer of the CSF adjacent the abrasive portion such that the abrasive article has a layered structure.

Non-Abrasive Portions

Other embodiments of an abrasive article and method of manufacturing it are disclosed. For example, an abrasive article 11 (FIGS. 10A-10G) may comprise an abrasive portion 13 having an axis 14, an organic bond and abrasive particles. The abrasive article 11 also may include a non-abrasive portion (NAP) 15 coupled to the abrasive portion 13. The abrasive portion 13 may comprise at least two layers (one shown). The NAP 15 may be located axially between the at least two layers of the abrasive portion. The abrasive portion 13 may comprise a grinding layer, and the NAP 15 may be bonded to the grinding layer. Some versions of the abrasive article 11 may consist exclusively of the abrasive portion 13 and the NAP 15.

Figure 11A:
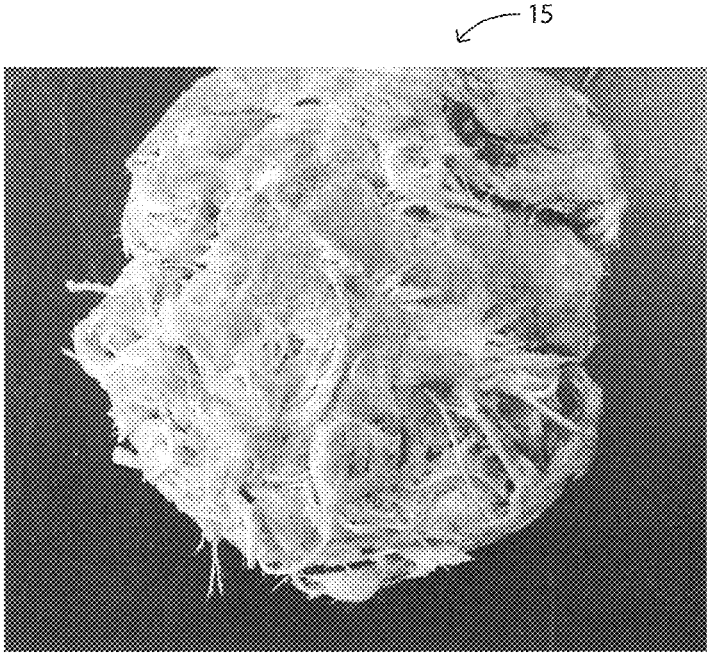
FIGS. 11A and 11B are photographs of an embodiment of bulk molding compound in a raw form and after processing, respectively.
Figure 11B:
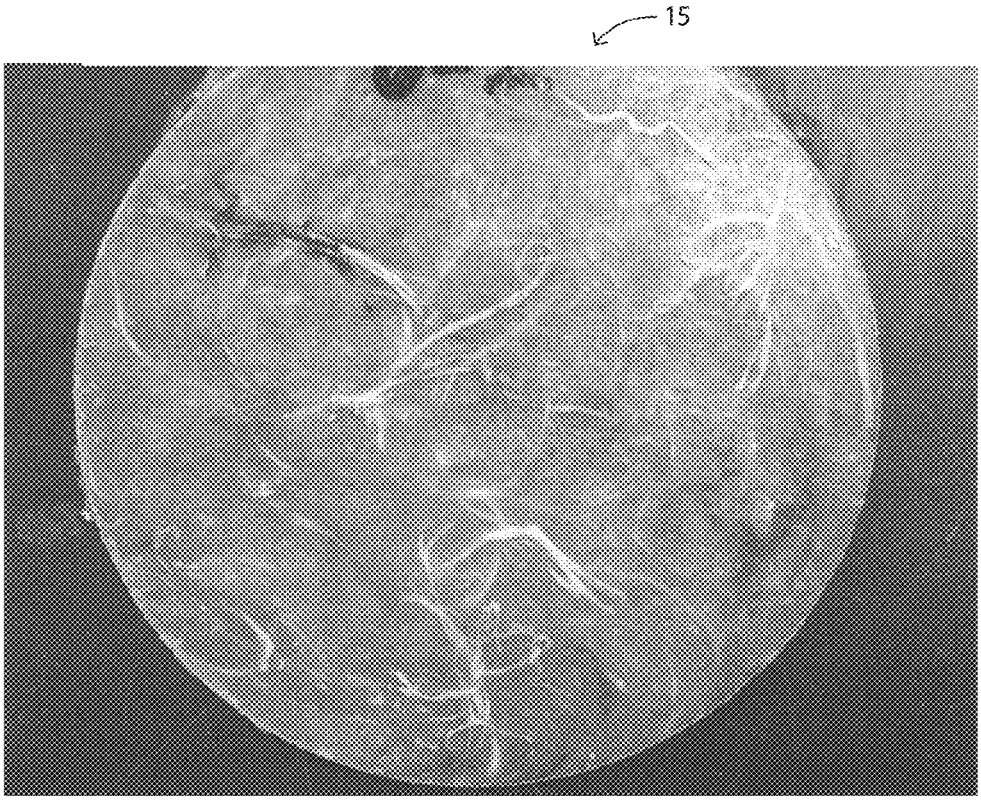

Embodiments of the NAP 15 may comprise a molding compound (MC) having no abrasive particles. Photographs of the MC are shown in FIG. 11A (a raw form) and FIG. 11B (after processing). Examples of the MC may comprise at least one of a bulk molding compound (BMC) and a sheet molding compound (SMC). For example, BMC may include at least one resin and at least one filler.

The MC also may include chopped strand fibers (CSF). The CSF may be mixed with the resin and filler to form a mass of BMC (FIG. 11A). The CSF may have up to 3 axes of orientation within the mass. Examples of the SMC may include at least one resin and at least one filler. In other versions, a layer of CSF may be deposited on the resin and filler. The CSF may have substantially only two axes of orientation in its layered or planar configuration.

In some embodiments, the NAP does not contain abrasive particles with a MOHS scale hardness of greater than about 9. In other words, everything within the NAP may have a MOHS scale hardness that is not greater than about 9. In still other versions, the NAP has a MOHS scale hardness that is not greater than about 9, such as not greater than about 7, or even not greater than about 5. In other examples, the NAP may have a MOHS scale hardness of at least about 1, such as at least about 2, or even at least about 3. The hardness of the NAP may be in a range between any of these minimum and maximum values.

Figure 10A:
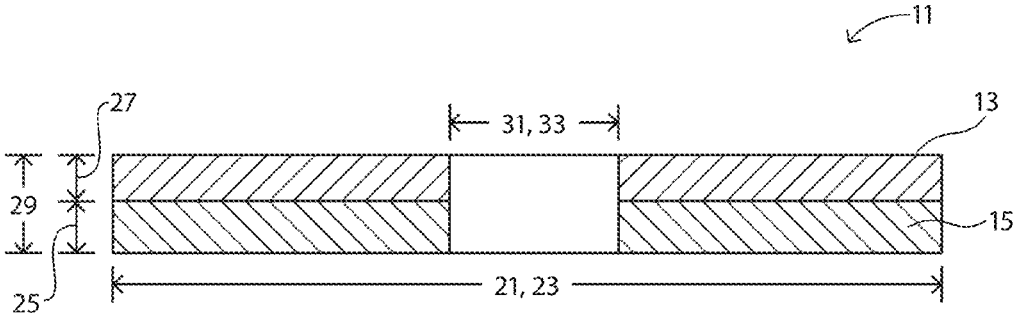
FIGS. 10A-10G are sectional side views of embodiments of abrasive articles.

As shown in FIG. 10A, the NAP may have an outer diameter 21 that is at least half of but not greater than an outer diameter 23 of the abrasive article. Outer diameters 21, 23 may be identical. In addition or alternatively, the NAP may have an axial thickness 25 that is in a range of about 7% to about 50% of an overall axial thickness of the abrasive articles. The axial thickness 25 may be less than, the same as, or greater than the axial thickness 27 of the abrasive portion 13. In another example, the NAP 15 and the abrasive portion 13 may have inner diameters 31, 33 and outer diameters 21, 23 that are, respectively, substantially equal.

Figure 10B:
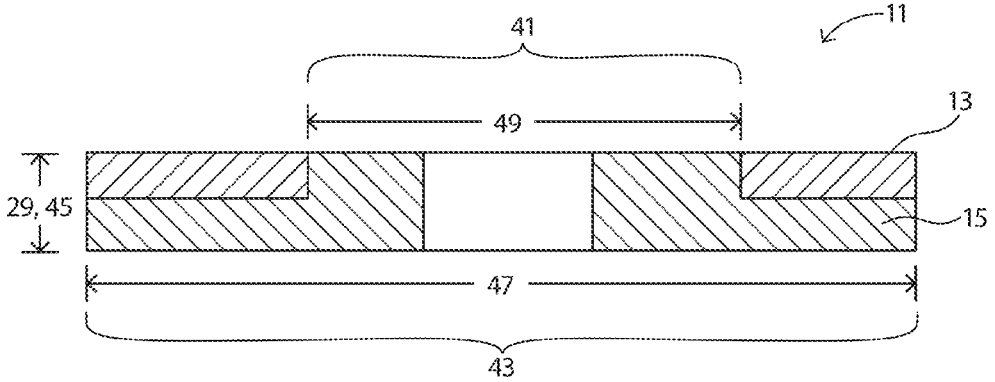

As shown in FIG. 10B, the NAP 15 may comprise a core 41 and a back layer 43 that is not a fine back layer. The term 'fine back layer' may be defined as a layer having at least some abrasive particles, whether the same or different than the abrasive particles in the abrasive portion 13. The core 41 and the back layer 43 may have a combined axial thickness 45 that is less than, equal to or greater than the axial thickness 29 of the abrasive article 11. The back layer 43 may be contiguous with the core 41, as shown in FIG. 10B.

The back layer 43 may have an outer diameter 47 that is greater than the outer diameter 49 of the core 41. The combined axial thickness 45 of the back layer 43 and the core 41 may be substantially equal to or greater than the axial thickness 29 of the abrasive article 11. Together, the back layer 43 and core 41 may form and have the appearance of a unitary top hat structure.

Figure 10C:
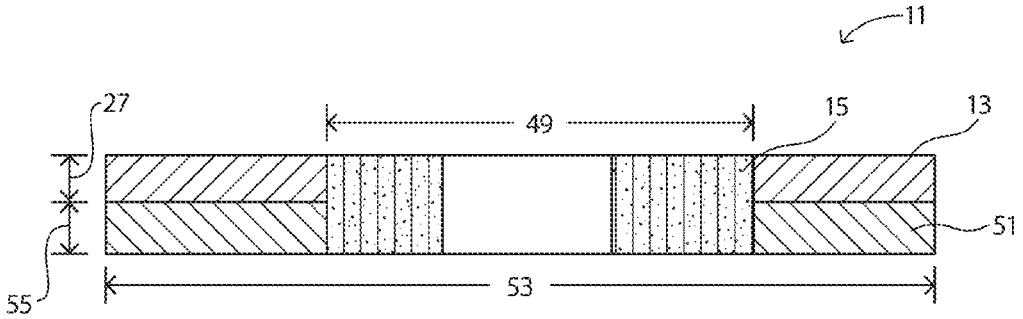

As shown in FIG. 10C, embodiments of the abrasive article 11 may further comprise a fine back layer 51 having abrasive particles and mounted to the abrasive portion 13. The abrasive particles can be the same or different abrasive particles than the abrasive portion 13. The fine back layer 51 may have an outer diameter 53 that is greater than the outer diameter 49 of the NAP 15. Embodiments of the fine back layer 51 may have an axial thickness 55 (FIG. 10C) that is less than the axial thickness 27 of the NAP 15. The NAP 15 can extend axially through both the abrasive portion 13 and the fine back layer 51.

Figure 10D:
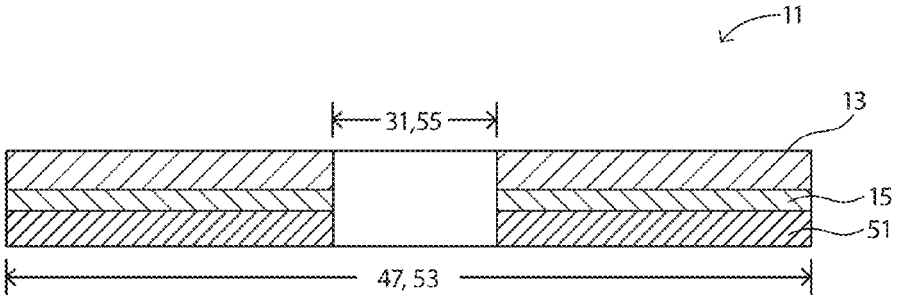

As shown in FIG. 10D, the NAP 15 and the fine back layer 51 may have inner diameters 31, 55 and outer diameters 47, 53 that are, respectively, substantially equal. The fine back layer 51 may have an axial thickness 55 that is substantially similar to the axial thickness 27 of the NAP 15.

Figure 10E:
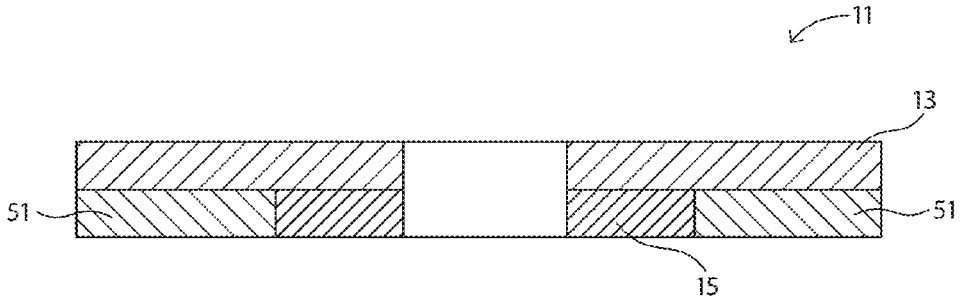
Figure 10F:
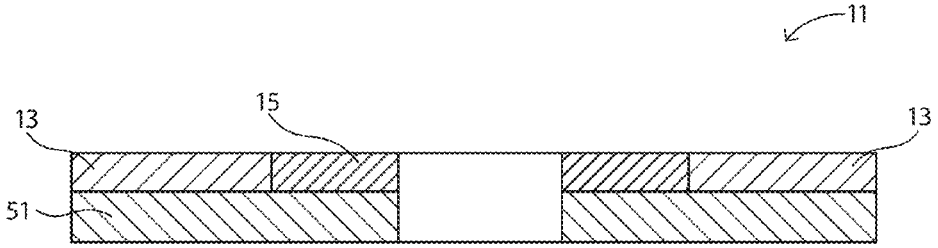
Figure 10G:
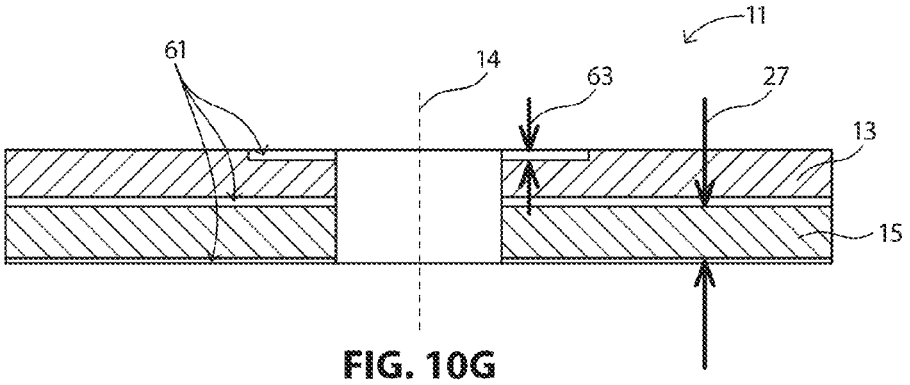

As shown in FIG. 10E, the NAP 15 can extend axially only through the fine back layer 51 and not through the abrasive portion 13. The fine back layer 51 can have an inner diameter 55 that is substantially equal to the inner diameter 31 of the NAP 15. As shown in FIG. 10F, the NAP 15 can extend axially only through the abrasive portion 13 and not through the fine back layer 51.

In some embodiments, the abrasive article 11 does not contain a continuous glass web to reinforce the abrasive article. In other versions (FIG. 10G), the abrasive article 11 may contain at least one continuous glass web 61 (e.g., three shown) to reinforce the abrasive article 11. The webs 61 may vary in size and other parameters, such as the different diameters shown in FIG. 10G. Embodiments of the NAP 15 may have an axial thickness 27 that is greater than the axial thickness 63 of the continuous glass web 61.

Embodiments of the MC may comprise a resin, such as a phenolic resin. Other embodiments may comprise a novolac phenolic resin having a melting temperature of less than about 90° C. Alternatively or in addition, the MC may include a solvent-free, liquid phenolic resin resole. The MC may have a specific gravity in a range of about 1.4 to about 1.9. Some versions of the MC may comprise a thermosetting composition. Other embodiments of the MC may comprise at least one of hexamethylenetetramine (HMTA) and a novolac phenolic resin having a melting temperature of at least about 100° C.

Embodiments of the NAP also may comprise a solid, pre-formed core for the abrasive article. The pre-formed core, also known as a pre-preg, may not be fully cured, and/or may be formed from a material with a softening point below about 150° C. In other embodiments, the NAP may comprise at least one of porosity, chopped strand fibers (CSF), milled fibers, microfibers, organic fillers and inorganic fillers. Such functional fillers may be useful for strength, impact resistance, and/or sound and vibration dampening.

Some embodiments of the NAP may comprise at least about 20 vol % CSF. For example, the NAP may include at least about 25 vol % CSF, such as at least about 30 vol %, or even at least about 35 vol %. In other versions, the NAP may include not greater than about 40 vol % CSF, such as not greater than about 35 vol %, not greater than about 30 vol %, or even not greater than about 25 vol %. The CSF content of the NAP may be in a range between any of these minimum and maximum values.

In other embodiments, a method of fabricating an abrasive article is disclosed. The method may comprise forming a molding compound (MC) that is non-abrasive and comprises a novolac phenolic resin having a melting temperature of less than about 90° C., and a solvent-free, liquid phenolic resin resole. Forming the MC may include forming the MC into a pre-preg that is solid, and placing may comprise placing the solid pre-preg in the mold.

The method may further include forming an abrasive matrix comprising an organic bond and abrasive particles; placing the MC and the abrasive matrix into a mold; and pressurizing the MC and abrasive matrix to conform to the mold and form the abrasive article. Prior to pressurizing, the pre-preg may be at least one of not fully cured and a material with a softening point below about 150° C.

As stated herein, the MC may comprise at least one of BMC and SMC. In the case of SMC, forming may comprise forming SMC into a sheet prior to placing it in the mold. Embodiments of the MC may comprise a highly viscous paste. The MC may have a putty-like consistency, it may be moist and not dry. Forming may include forming the MC with high shear mixing. Forming also may include forming the MC in a temperature range of about 60° C. to about 80° C. In other embodiments of the method, forming may comprise mixing the CSF into the MC (e.g., the BMC). In another example, placing may comprise forming a layer of the CSF between the MC (e.g., SMC) and the abrasive matrix. The method may further comprise applying heat to the MC during at least one of forming and placing.

Embodiments of the method may further comprise removing the abrasive article from the mold, and then curing the abrasive article without the use of stacking plates. Pressurizing may further comprise heating to sufficiently cure the abrasive article such that, after removal of the abrasive article from the mold, no subsequent curing is required.

Embodiments of placing may comprise separately placing the MC and the abrasive matrix into the mold cavity. Placing also may comprise at least one of injecting and dropping the MC and the abrasive matrix into the mold cavity. In other versions, placing ma comprise placing a layer of the CSF in the mold with the MC and the abrasive matrix. The method may include chopping at least one of a continuous strand yarn and continuous strand roving into chopped strand fibers (CSF) and depositing them in the mold before pressurizing it. Accordingly, pressurizing may comprise molding the abrasive article such that the CSF forms a reinforcement layer for the abrasive article.

As described herein, CSF may be used as an alternative to or in addition to continuous glass webs. CSF is a lower labor and resource intensive process than incorporating webs. Usage of CSF can eliminate or reduce waste to provide a zero fiber waste process. In addition, CSF requires a smaller storage footprint in the manufacturing facility and provides a highly flexible method to manipulate and prescribe wheel properties and performance. Examples of the flexibility in manipulating the wheel properties and performance include changing the chopped length of the fibers, the bundle size, the fiber type, and the fiber amount. CSF provides similar strength, fracture toughness, and specific work of fracture as conventional wheels with phenolic-coated web products.

Embodiments of a solution that reduce or eliminate many prior art issues use a highly viscous paste containing one or more resins, fillers and CSF. The viscous paste may be a non-abrasive BMC or SMC that is used to make abrasive articles such as grinding wheels. BMC can be injected or dropped into a mold cavity and forced to flow into a desired geometry using pressure. Application of heat either during the flow or after the flow achieves a solid part that can be subsequently cured without the use of stacking plates. The degree of cure can be tailored by the time and temperature of the BMC in the mold so as to minimize or eliminate the post curing step.

Grinding wheels generate both noise and vibration during use. Long term exposure to vibrations and noise can put operators at risk. One such risk is a vascular disorder known as Raynaud's syndrome. Government regulations have been enacted to protect workers by limiting their exposure to noise and vibration. The prior art teaches that multiple compliant layers between the grinding wheel and the grinder can reduce vibration. Other studies have shown that incorporating non-binding layers (e.g., paper) within the grinding wheel composition can also reduce noise and vibration. However, paper is detrimental to wheel integrity since burst speed (and presumably side load) is significantly lowered by nonbinding layers. Additionally, this approach requires efficient transfer and high precision placement of partial sheets of very thin nonbinding material into the mold cavity. To address these issues, embodiments of a method for incorporating adhesively bound sound and vibration dampening layers at precise locations within the wheel without compromising safety (i.e. side load or burst speed) or grinding performance also are disclosed.

Other embodiments described herein overcome obstacles by using chemically compatible BMC or SMC pre-pregs placed between the grinding layers. Alternatively, the BMC/SMC pre-pregs may be substituted for the mix at either the core and/or the backing (e.g., fine back) of the wheel. The BMC or SMC can be formulated to include sound/vibration dampening agents that include one or more of porosity, CSF and fillers without affecting the adhesion between the abrasive layers. Embodiments provide adequate adhesion of BMC to grinding mix as determined by a lack of delamination from a side load to failure testing.

In other embodiments, a multiphase grinding composition that can be molded in one step is disclosed. A pre-shaped phenolic BMC prepreg may be used in the shuttle box process to make a type 27 wheel in two steps: placing the pre-shaped prepreg into the cavity, and then adding the grinding zone formulation, followed by pressing. The wheel construction in which both the fine back and core are replaced with a pre-shaped phenolic BMC prepreg is depicted in FIG. 1B, and yielded a wheel that was 20% lighter in weight than a conventional wheel. Moreover, the grinding abrasive is concentrated at the outer one-third of the wheel periphery and provided burst speed and side load test results that were comparable to a standard wheel having 3 glass webs.

Embodiments of a solvent-free, fiber reinforced, thermosetting phenolic molding compound also is disclosed. Such embodiments may overcome prior art limitations by dispersing CSF into a thermosetting composition comprising a solvent-free liquid resole, hexamethylenetetramine (HMTA), and either a low melting novolac or a combination of low and high melting novolacs using high shear mixing. Complete fiber dispersion (i.e., fiber bundle to filament) and intimate wetting of the ingredients may be achieved in a range of about 60° C. to about 100° C. (i.e., below the decomposition temperature of HMTA) using, for example, a Brabender. The resultant embodiment may produce a CFS-reinforced, low melting compound that can be pressed into a finished shape, or combined with abrasives and then molded into a finished shape.

Additional embodiments of an abrasive article may comprise a back layer mounted to the abrasive portion. The back layer may include discrete elastomeric particles.

Embodiments of the back layer may comprise a plurality of back layers. In some versions, each of the back layers may comprise discrete elastomeric particles. At least one of the plurality of back layers can include a rubber-modified phenolic resin. The back layer may or may not have abrasive particles. The abrasive particles of the back layer may be the same or different than the abrasive particles in the abrasive portion.

Embodiments of the discrete elastomeric particles can be rubber particles, pre-crosslinked rubber particles or a combination thereof. In some versions, the discrete elastomeric particles are not and do not contain rubber-modified phenolic resin.

The abrasive article may comprise a flexible wheel that is axially deflectable at a perimeter thereof without damaging the abrasive article.

Embodiments of the abrasive article can have a flexibility that is at least about 5% lower than that of a conventional abrasive article. For example, the flexibility can be at least about 10% lower, such as at least about 20% lower, at least about 30% lower, at least about 40% lower, at least about 50% lower, at least about 60% lower, at least about 70% lower, at least about 80% lower, or even at least about 90% lower than that of the conventional abrasive article. In other versions, the flexibility is not greater than about 200% lower than that of the conventional abrasive article, such as not greater than about 150% lower, or even not greater than about 125% lower than that of the conventional abrasive article. The flexibility can be in a range between any of these minimum and maximum values.

In some embodiments of the abrasive article, for up to about 5 mm of initial deflection without pre-stress, the abrasive article can have a flexibility that is at least about 2.75 mm/kN. For example, the flexibility can be at least about 3 mm/kN, such as at least about 3.25 mm/kN, or even at least about 3.5 mm/kN. In other examples, the flexibility can be not greater than about 5 mm/kN, such as not greater than about 4 mm/kN, or even not greater than about 3.75 mm/kN. The flexibility can be in a range between any of these minimum and maximum values.

In other embodiments of the abrasive article, for up to about 5 mm of deflection and when pre-stressed, the abrasive article can have a flexibility that is at least about 6.5 mm/kN. For example, the flexibility can be at least about 8 mm/kN, such as at least about 10 mm/kN, or even at least about 12 mm/kN. In other versions, the flexibility can be not greater than about 20 mm/kN, such as not greater than about 15 mm/kN, or even not greater than about 13 mm/kN. The flexibility can be in a range between any of these minimum and maximum values.

Embodiments of the back layer may comprise at least about 25 vol % of the abrasive article. For example, the back layer can be at least about 30 vol % of the abrasive article, such as at least about 35 vol %, or even at least about 40 vol % of the abrasive article. In other versions, the back layer can be not greater than about 50 vol % of the abrasive article, such as not greater than about 45 vol %, or even not greater than about 40 vol % of the abrasive article. The content of the back layer in the abrasive article can be in a range between any of these minimum and maximum values.

In some versions of the abrasive article, the discrete elastomeric particles can have an average particle size of at least about 1 micron. For example, the average particle size can be at least about 5 microns, such as at least about 10 microns, at least about 15 microns, at least about 20 microns, at least about 25 microns, or even at least about 30 microns. In other examples, the average particle size can be not greater than about 60 microns, such as not greater than about 50 microns, not greater than about 45 microns, not greater than about 40 microns, or even not greater than about 35 microns. The average particle size can be in a range between any of these minimum and maximum values.

Other embodiments of the abrasive article can include the discrete elastomeric particles to comprise at least about 10 vol % of the back layer. In other versions, the discrete elastomeric particles can be at least about 15 vol % of the back layer, such as at least about 20 vol %. In still other versions, the discrete elastomeric particles can comprise not greater than about 30 vol % of the back layer, such as not greater than about 25 vol %, or even not greater than about 20 vol % of the back layer. The particle content of the back layer can be in a range between any of these minimum and maximum values.

In some examples, the discrete elastomeric particles may comprise a glass transition temperature (Tg) of less than about 100° C. For example, the Tg can be less than about 80° C., such as less than about 60° C., less than about 40° C., or even less than about 30° C. In other versions, the Tg can be at least about 10° C., such as at least about 20° C., at least about 30° C., at least about 40° C., or even at least about 50° C. The Tg also can be in a range defined between any of these values.

Examples of the discrete elastomeric particles can be dry blended into a back formulation. In another example, the back layer can be molded onto the abrasive portion of the abrasive article.

Embodiments of the abrasive article can be mechanically pre-stressed. Other embodiments of the abrasive article are not mechanically pre-stressed. The abrasive article also can include micro cracks in the abrasive portion. Other versions of the abrasive article do not include micro cracks in the abrasive portion.

In some examples, the back layer may comprise BMC having clay. Versions of the back layer can have a volume of clay within the back layer that exceeds a volume of the discrete elastomeric particles within the back layer. For example, the back layer can include at least about 2% clay, such as at least about 5%, at least about 10%, or even at least about 15%. In other versions, the back layer can include not greater than about 25% clay, such as not greater than about 20%, not greater than about 15%, not greater than about 10%, or even not greater than about 5%. The clay content of the back layer can be in a range between any of these values.

In other versions, the volume of clay within the back layer is less than a volume of the discrete elastomeric particles within the back layer. For example, the back layer can include at least about 10% less clay than discrete elastomeric particles, such as at least about 25%, at least about 50%, or even at least about 75%. The content of clay relative to the discrete elastomeric particles can be in a range between any of these values.

Versions of the abrasive article can have a volumetric ratio of microfibers to discrete elastomeric particles in the abrasive article. The volumetric ratio can be at least about 1:1. In other versions, the volumetric ration can be at least about 1.5:1, such as at least about 2:1, at least about 2.5:1, at least about 3:1, or even at least about 5:1. In still other versions, the volumetric ration can be not greater than about 20:1, such as not greater than about 15:1, not greater than about 10:1, or even not greater than about 5:1. The volumetric ratio can be in a range between any of these minimum and maximum values.

Examples of the microfibers can include at least one of mineral fibers and carbon-based fibers. Other examples of the microfibers can include mechanically milled microfibers. Still other examples of the microfibers can include milled carbon fibers.

Embodiments of the microfibers can have an aspect ratio of length:diameter (L:D) of at least about 10. For example, the aspect ratio can be at least about 25, such as at least about 50, or even at least about 75. In other versions, the aspect ratio can be not greater than about 120, such as not greater than about 100, not greater than about 80, or even not greater than about 60. The aspect ratio can be in a range between any of these minimum and maximum values.

Some versions of the abrasive article include an abrasive portion that may include at least about 5 vol % of the microfibers. In other versions, the abrasive portion can include at least about 6 vol %, such as at least about 8 vol % of the microfibers. In still other versions, the abrasive portion can include not greater than about 20 vol %, not greater than about 15 vol %, or even not greater than about 10 vol % of the microfibers. The microfiber content can be in a range between any of these minimum and maximum values.

Embodiments of the microfibers may be coated, such as with silane coupling agents.

In still other embodiments, a method of fabricating an abrasive article is disclosed. The method may comprise, for example, forming an abrasive portion having an organic bond and abrasive particles; forming a back layer having discrete elastomeric particles; and mounting the back layer to the abrasive portion to form the abrasive article.

The method may further comprise pre-crosslinking the discrete elastomeric particles prior to forming the back layer. The method may include forming the back layer by dry blending the discrete elastomeric particles into a back formulation. In other versions, the method may include mounting by molding the back layer onto the abrasive portion.

Other embodiments of the may further comprise mechanically pre-stressing the abrasive article. The method also may further comprise not mechanically pre-stressing the abrasive article. A version of the method may further comprise forming micro cracks in the abrasive portion. A different version of the method may further comprise not forming micro cracks in the abrasive portion.

Some embodiments of the method comprise forming the abrasive portion by including microfibers in the abrasive portion. The method may further comprise at least one of mechanically milling the microfibers, coating the microfibers, and dry blending the microfibers into the abrasive portion.

The MC can include a thermosetting phenolic material with a room temperature viscosity of 1 to 2 million pascal-sec. The material also can have a viscosity of 0.05 to 0.2 pascal-sec at 100° C. This material can subsequently cure and reach a maximum viscosity above 125° C. or, in some embodiments, above 150° C.

The embodiments described herein can provides a means to incorporate a wider range of materials into abrasive wheels using traditional processing steps otherwise not possible with conventional phenolic resins and reinforcements. These embodiments can provide wheels with demonstrated lower weight, lower cost, a wider range of flexibility and higher performance without compromising strength and EOF. Other potential may include noise and vibration dampening.

As used herein, terms such as "reinforced" or "reinforcement" may refer to discontinuous components of a reinforcing material that is different from the bond and abrasive materials employed to make the bonded abrasive tool. Terms such as "internal reinforcement" or "internally reinforced" indicate that these components are within or embedded in the body of the tool. Background details related to reinforcement techniques and materials are described, for example, in U.S. Pat. No. 3,838,543, which is incorporated herein by reference in its entirety. Reinforced wheels also are described in U.S. Pat. Nos. 6,749,496, and 6,942,561, both of which are incorporated herein by reference in their entirety.

An exemplary binder system may include one or more organic resins, such as phenolic resin, boron-modified resin, nano-particle-modified resin, urea-formaldehyde resin, acrylic resin, epoxy resin, polybenzoxazine, polyester resin, isocyanurate resin, melamine-formaldehyde resin, polyimide resin, other suitable thermosetting or thermoplastic resins, or any combination thereof.

Specific, non-limiting examples of resins that can be used include the following: the resins sold by Dynea Oy, Finland, under the trade name Prefere and available under the catalog/product numbers 8522G, 8528G, 8680G, and 8723G; the resins sold by Hexion Specialty Chemicals, OH, under the trade name Rutaphen® and available under the catalog/product numbers 9507P, 8686SP, and SP223; and the resins sold by Sumitomo, formerly Durez Corporation, TX, under the following catalog/product numbers: 29344, 29346, and 29722. In an example, the bond material comprises a dry resin material.

An exemplary phenolic resin includes resole and novolac. Resole phenolic resins can be alkaline catalyzed and have a ratio of formaldehyde to phenol of greater than or equal to one, such as from 1:1 to 3:1. Novolac phenolic resins can be acid catalyzed and have a ratio of formaldehyde to phenol of less than one, such as 0.5:1 to 0.8:1.

An epoxy resin can include an aromatic epoxy or an aliphatic epoxy. Aromatic epoxies components include one or more epoxy groups and one or more aromatic rings. An example aromatic epoxy includes epoxy derived from a polyphenol, e.g., from bisphenols, such as bisphenol A (4,4'-isopropylidenediphenol), bisphenol F (bis[4-hydroxyphenyl]methane), bisphenol S (4,4'-sulfonyldiphenol), 4,4'-cyclohexylidenebisphenol, 4,4'-biphenol, 4,4'-(9-fluorenylidene)diphenol, or any combination thereof. The bisphenol can be alkoxylated (e.g., ethoxylated or propoxylated) or halogenated (e.g., brominated). Examples of bisphenol epoxies include bisphenol diglycidyl ethers, such as diglycidyl ether of Bisphenol A or Bisphenol F. A further example of an aromatic epoxy includes triphenylolmethane triglycidyl ether, 1,1,1-tris(p-hydroxyphenyl)ethane triglycidyl ether, or an aromatic epoxy derived from a monophenol, e.g., from resorcinol (for example, resorcin diglycidyl ether) or hydroquinone (for example, hydroquinone diglycidyl ether). Another example is nonylphenyl glycidyl ether. In addition, an example of an aromatic epoxy includes epoxy novolac, for example, phenol epoxy novolac and cresol epoxy novolac. Aliphatic epoxy components have one or more epoxy groups and are free of aromatic rings. The external phase can include one or more aliphatic epoxies. An example of an aliphatic epoxy includes glycidyl ether of C2-C30 alkyl; 1,2 epoxy of C3-C30 alkyl; mono or multiglycidyl ether of an aliphatic alcohol or polyol such as 1,4-butanediol, neopentyl glycol, cyclohexane dimethanol, dibromo neopentyl glycol, trimethylol propane, polytetramethylene oxide, polyethylene oxide, polypropylene oxide, glycerol, and alkoxylated aliphatic alcohols; or polyols. In one embodiment, the aliphatic epoxy includes one or more cycloaliphatic ring structures. For example, the aliphatic epoxy can have one or more cyclohexene oxide structures, for example, two cyclohexene oxide structures.

An example of an aliphatic epoxy comprising a ring structure includes hydrogenated bisphenol A diglycidyl ether, hydrogenated bisphenol F diglycidyl ether, hydrogenated bisphenol S diglycidyl ether, bis(4-hydroxycyclohexyl)methane diglycidyl ether, 2,2-bis(4-hydroxycyclohexyl)propane diglycidyl ether, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, di(3,4-epoxycyclohexylmethyl) hexanedioate, di(3,4-epoxy-6methylcyclohexylmethyl) hexanedioate, ethylenebis(3,4-epoxycyclohexanecarboxylate), ethanedioldi(3,4-epoxycyclohexylmethyl) ether, or 2-(3,4-epoxycyclohexyl-5,5-spiro-3,4-epoxy)cyclohexane-1,3-dioxane.

In still other embodiments, the abrasive article may include one or more of the following items:

Item 1. An abrasive article, comprising:

an abrasive portion having an organic bond and abrasive particles; and a non-abrasive portion (NAP) mounted to the abrasive portion, the NAP comprising molding compound (MC) having chopped strand fibers (CSF) coated with a thermoplastic coating having a loss on ignition (LOI) of at least about 2.4 wt %, and the NAP has no abrasive particles.

Item 2. An abrasive article, comprising:

an abrasive portion having an organic bond and abrasive particles; and a non-abrasive portion (NAP) mounted to the abrasive portion, the NAP comprising a molding compound (MC) having no abrasive particles with a MOHS scale hardness of at least about 9, and chopped strand fibers (CSF) coated with a primary coating and a secondary coating on the primary coating, and the NAP has an outer diameter that is at least half of but not greater than an outer diameter of the abrasive article, and the NAP has an axial thickness that is at least about 7% of an overall axial thickness of the abrasive article, and not greater than about 50% of the overall axial thickness of the abrasive article.

Item 3. An abrasive article, comprising:

an abrasive portion having an organic bond, abrasive particles and microfibers; and a back layer mounted to the abrasive portion, and the back layer comprises discrete elastomeric particles and chopped strand fibers (CSF), and at least some of the CSF have a length of at least about 6.3 mm.

Item 4. An abrasive article, comprising:

an abrasive portion having an organic bond, abrasive particles and microfibers;

a non-abrasive portion (NAP) mounted to the abrasive portion, the NAP comprising molding compound (MC) having discrete elastomeric particles, chopped strand fibers (CSF), and no abrasive particles; and the abrasive article has a work of fracture (wof) that is at least about 1% greater than that of a conventional abrasive article (CAA), and the CAA comprises at least one of:

(a) CSF with a coating having an LOI of less than 2 wt %;

(b) CSF without a secondary coating; and (c) CSF having a length of less than 6.3 mm.

Item 5. The abrasive article of any of these items, wherein the CSF has a primary coating and the thermoplastic coating is a secondary coating on the primary coating.

Item 6. The abrasive article of any of these items, wherein the CSF further comprises a direct sized coating, and the thermoplastic coating is a secondary coating on the direct sized coating.

Item 7. The abrasive article of any of these items, wherein the direct sized coating has an LOI of less than about 2 wt %.

Item 8. The abrasive article of any of these items, wherein the CSF comprises a yield in a range of about 134 TEX (3700 yd/lb) to about 1830 TEX (271 yd/lb).

Item 9. The abrasive article of any of these items, wherein the CSF comprises a yield of at least 125 TEX, at least 250 TEX, at least 500 TEX, at least 750 TEX, at least 1000 TEX, at least 1500 TEX, and not greater than about 2000 TEX, not greater than about 1500 TEX, not greater than about 1000 TEX, not greater than about 750 TEX, not greater than about 500 TEX, not greater than about 250 TEX.

Item 10. The abrasive article of any of these items, wherein the abrasive article does not have a continuous fiber reinforcement, such that the abrasive article is reinforced only by the CSF.

Item 11. The abrasive article of any of these items, wherein the CSF have a maximum length, and at least some of the CSF are within about 10% of the maximum length, within about 5% of the maximum length, about 90% of the CSF are within about 10% of the maximum length, about 95% of the CSF are within about 10% of the maximum length, or about 95% of the CSF are within about 5% of the maximum length.

Item 12. The abrasive article of any of these items, wherein a length of at least some of the CSF is at least about 6.3 mm, at least about 7 mm, at least about 8 mm, at least about 10 mm, at least about 12 mm, at least about 15 mm, at least about 20 mm, and not greater than about 125 mm, not greater than about 100 mm, not greater than about 75 mm, not greater than about 50 mm, not greater than about 40 mm, or not greater than about 30 mm.

Item 13. The abrasive article of any of these items, wherein the coating comprises a high hydrogen-bonding capacity polymer, wherein the thermoplastic coating comprises a thermoplastic polymer -(A-B)— made with monomers A and B, where the B segment of the polymer contains at least 2-XHn functionalities, where X=O or N or S, and n=1 or 2.

Item 14. The abrasive article of any of these items, wherein the CSF have a coating comprising at least one of a thermoplastic, thermoplastic novolac, phenoxy, polyurethane, or any combination thereof.

Item 15. The abrasive article of any of these items, wherein the coating is substantially not cross-linked.

Item 16. The abrasive article of any of these items, wherein less than about 5% of the coating is cross-linked.

Item 17. The abrasive article of any of these items, wherein the coating comprises a LOI of at least about 2 wt %, at least about 3 wt %, at least about 5 wt %, at least about 7 wt %, at least about 9 wt %, at least about 12 wt %, at least about 15 wt %, and not greater than about 25 wt %, not greater than about 20 wt %, not greater than about 15 wt %, or not greater than about 12 wt %.

Item 18. The abrasive article of any of these items, wherein the abrasive article has a work of fracture (wof) that is at least about 1% greater than that of a conventional abrasive article (CAA), at least about 2% greater, at least about 3% greater, at least about 5% greater, at least about 7% greater, or at least about 10% greater than that of the CAA, and the CAA comprises:

(a) CSF with a coating having an LOI of less than 2 wt %;

(b) CSF without a secondary coating; or (d) CSF having a length of less than 6.3 mm.

Item 19. The abrasive article of any of these items wherein, compared to a conventional abrasive article (CAA) reinforced with a continuous fiber web and no CSF, the abrasive article has:

a work of fracture (Wof) that is within about 5% of that of the CAA, within about 10%, or within about 15% of that of the CAA.

Item 20. The abrasive article of any of these items wherein, compared to a conventional abrasive article (CAA) reinforced with a continuous fiber web and no CSF, the abrasive article has:

a strength (psi) that is within about 1% of that of the CAA, within about 5%, or within about 10% of that of the CAA.

Item 21. The abrasive article of any of these items wherein, compared to a conventional abrasive article (CAA) reinforced with a continuous fiber web and no CSF, the abrasive article has:

a toughness ($G_{1C}$) that is within about 1% of that of the CAA, within about 5%, or within about 10% of that of the CAA.

Item 22. The abrasive article of any of these items, wherein the CSF are dispersed in at least a portion of the abrasive article.

Item 23. The abrasive article of any of these items, wherein the CSF are substantially randomly distributed throughout the abrasive portion.

Item 24. The abrasive article of any of these items, wherein the abrasive article has an axial thickness, and the CSF has a maximum length that is not greater than the axial thickness.

Item 25. The abrasive article of any of these items, wherein the CSF are formed as a discrete layer in the abrasive mix.

Item 26. The abrasive article of any of these items, wherein the discrete layer of comprises a plurality of discrete layers that are axially separated from each other by portions of the abrasive mix.

Item 27. The abrasive article of any of these items, wherein the discrete layer is a sintered mat of the CSF such that the CSF are integral.

Item 28. The abrasive article of any of these items, wherein the abrasive article is a wheel having an axis, an outer diameter (OD) and an inner diameter (ID), and a maximum length of the CSF is not greater than (OD−ID)/2.

Item 29. The abrasive article of any of these items, wherein the abrasive article further comprises at least one web formed from continuous fiber reinforcement, such that the abrasive body is reinforced by the CSF and the web.

Item 30. The abrasive article of any of these items, wherein the abrasive article comprises a volume percentage of the CSF of at least about 1 vol %, at least about 2 vol %, at least about 3 vol %, at least about 4 vol %, at least about 5 vol %, at least about 6 vol %, at least about 9 vol %, and not greater than about 25 vol %, not greater than about 20 vol %, not greater than about 15 vol %.

Item 1. The abrasive article of any of these items, wherein the abrasive article comprises about 25 vol % to about 50 vol % of the organic bond, about 40 vol % to about 70 vol % of the abrasive particles, and about 6 vol % to about 12 vol % of the CSF.

Item 32. The abrasive article of any of these items, wherein the MC is at least one of a bulk molding compound (BMC) and a sheet molding compound (SMC).

Item 3. The abrasive article of any of these items, wherein components within the NAP comprise has a MOHS scale hardness that is less than about 9, less than about 8, less than about 7, less than about 6, less than about 5, and at least about 1, at least about 2, at least about 3, or at least about.

Item 34. The abrasive article of any of these items, wherein the NAP and the abrasive portion have inner diameters and outer diameters that are substantially equal, respectively.

Item 35. The abrasive article of any of these items, wherein the NAP comprises a core and a back layer that is not a fine back layer, and the core and the back layer have a combined axial thickness that is not greater than the axial thickness of the abrasive article.

Item 36. The abrasive article of any of these items, wherein the back layer is contiguous with the core.

Item 37. The abrasive article of any of these items, wherein the back layer has an outer diameter that is greater than that of the core, the combined axial thickness of the back layer and the core is substantially equal to that of the abrasive article, and together the back layer and core form a unitary top hat structure.

Item 38. The abrasive article of any of these items, further comprising a fine back layer having abrasive particles and mounted to the abrasive portion.

Item 39. The abrasive article of any of these items, wherein the fine back layer has an outer diameter that is greater than that of the NAP.

Item 40. The abrasive article of any of these items, wherein the NAP and the fine back layer have inner and outer diameters that are, respectively, substantially equal.

Item 41. The abrasive article of any of these items, wherein the fine back layer has an axial thickness that is less than that of the NAP, and the NAP extends axially through both the abrasive portion and the fine back layer.

Item 42. The abrasive article of any of these items, wherein the fine back layer has an axial thickness that is substantially similar to that of the NAP, and the NAP extends axially only through the fine back layer and not through the abrasive portion.

Item 43. The abrasive article of any of these items, wherein the fine back layer has an inner diameter that is substantially equal to that of the NAP, and the NAP extends axially only through the abrasive portion and not through the fine back layer.

Item 44. The abrasive article of any of these items, wherein the abrasive portion comprises at least two layers, and the NAP is located axially between at least two layers of the abrasive portion.

Item 45. The abrasive article of any of these items, wherein the abrasive article does not contain a continuous glass web to reinforce the abrasive article.

Item 46. The abrasive article of any of these items, wherein the abrasive article contains at least one continuous glass web to reinforce the abrasive article.

Item 47. The abrasive article of any of these items, wherein the NAP has an axial thickness that is greater than that of the continuous glass web.

Item 48. The abrasive article of any of these items, wherein the MC comprises at least one of a solvent-free, liquid phenolic resin resole, and a novolac phenolic resin having a melting temperature of less than about 90° C., less than about 80° C., less than about 75° C.

Item 49. The abrasive article of any of these items, wherein the abrasive portion is a grinding layer, and the NAP is bonded to the grinding layer.

Item 50. The abrasive article of any of these items, wherein the NAP comprises a solid, pre-formed core for the abrasive article.

Item 51. The abrasive article of any of these items, wherein a specific gravity of the MC is at least about 1.4, at least about 1.5, at least about 1.6, at least about 1.7, and not greater than about 1.9, not greater than about 1.8, or not greater than about 1.7.

Item 52. The abrasive article of any of these items, wherein the abrasive article consists exclusively of the abrasive portion and the NAP.

Item 53. The abrasive article of any of these items, wherein the NAP comprises at least one of porosity, milled fibers, microfibers, organic fillers and inorganic fillers.

Item 54. The abrasive article of any of these items, wherein the MC is a thermosetting composition.

Item 55. The abrasive article of any of these items, wherein the NAP comprises chopped strand fibers (CSF), wherein the NAP comprises at least about 20 vol % CSF, at least about 25 vol %, at least about 30 vol %, at least about 35 vol %, and not greater than about 40 vol %, not greater than about 35 vol %, not greater than about 30 vol %, not greater than about 25 vol %.

Item 56. The abrasive article of any of these items, wherein the MC comprises at least one of hexamethylene tetramine (HMTA) and a novolac phenolic resin having a melting temperature of at least about 70° C., at least about 80° C., at least about 90° C., or at least about 100° C.

Item 57. The abrasive article of any of these items, wherein the CSF comprises at least one of glass fibers, carbon fibers and aramid fibers.

Item 58. The abrasive article of any of these items, wherein the MC comprises a crosslinking agent comprising at least one of hexamethylene tetramine, multifunctional epoxy and polybenzoxazole (PBO).

Item 59. The abrasive article of any of these items, wherein the MC comprises a plurality of layers, each of which has an axial thickness that is less than that of a continuous glass web.

Item 60. The abrasive article of any of these items, wherein the MC has no abrasive particles with a MOHS scale hardness of about 10.

Item 61. The abrasive article of any of these items, wherein the discrete elastomeric particles are rubber particles or pre-crosslinked rubber particles.

Item 62. The abrasive article of any of these items, wherein the discrete elastomeric particles are not rubber-modified phenolic resin.

Item 65. The abrasive article of any of these items, wherein the abrasive article is a flexible wheel that is axially deflectable at a perimeter thereof without damaging the abrasive article.

Item 66. The abrasive article of any of these items, wherein the abrasive article has a flexibility that is at least about 5% lower than that of a conventional abrasive article, at least about 10% lower, at least about 20% lower, at least about 30% lower, at least about 40% lower, at least about 50% lower, at least about 60% lower, at least about 70% lower, at least about 80% lower, at least about 90% lower than that of the conventional abrasive article, and not greater than about 200% lower than that of the conventional abrasive article, not greater than about 150% lower, or not greater than about 125% lower than that of the conventional abrasive article.

Item 67. The abrasive article of any of these items wherein, for up to about 5 mm of deflection and when pre-stressed, the abrasive article has a flexibility that is at least about 6.5 mm/kN, at least about 8 mm/kN, at least about 10 mm/kN, at least about 12 mm/kN, and not greater than about 20 mm/kN, not greater than about 15 mm/kN, or not greater than about 13 mm/kN.

Item 68. The abrasive article of any of these items wherein, for up to about 5 mm of initial deflection without pre-stress, the abrasive article has a flexibility that is at least about 2.75 mm/kN, at least about 3 mm/kN, at least about 3.25 mm/kN, at least about 3.5 mm/kN, and not greater than about 5 mm/kN, not greater than about 4 mm/kN, or not greater than about 3.75 mm/kN.

Item 69. The abrasive article of any of these items, wherein the back layer comprises abrasive particles.

Item 70. The abrasive article of any of these items, wherein the back layer comprises at least about 25 vol % of the abrasive article, at least about 30 vol %, at least about 35 vol %, at least about 40 vol % of the abrasive article, and not greater than about 50 vol % of the abrasive article, not greater than about 45 vol %, or not greater than about 40 vol % of the abrasive article.

Item 71. The abrasive article of any of these items, wherein the discrete elastomeric particles have a average particle size of at least about 1 micron, at least about 5 microns, at least about 10 microns, at least about 15 microns, at least about 20 microns, at least about 25 microns, at least about 30 microns, and not greater than about 60 microns, not greater than about 50 microns, not greater than about 45 microns, not greater than about 40 microns, or not greater than about 35 microns.

Item 72. The abrasive article of any of these items, wherein the discrete elastomeric particles comprise at least about 10 vol % of the back layer, at least about 15 vol %, at least about 20 vol %, and not greater than about 30 vol %, not greater than about 25 vol %, or not greater than about 20 vol % of the back layer.

Item 73. The abrasive article of any of these items, wherein the discrete elastomeric particles are dry blended into a back formulation.

Item 74. The abrasive article of any of these items, wherein the back layer is molded onto the abrasive portion of the abrasive article.

Item 75. The abrasive article of any of these items, wherein the abrasive article is mechanically pre-stressed.

Item 76. The abrasive article of any of these items, wherein the abrasive article is not mechanically pre-stressed.

Item 77. The abrasive article of any of these items, wherein the abrasive article comprises micro cracks in the abrasive portion.

Item 78. The abrasive article of any of these items, wherein the abrasive article does not have micro cracks in the abrasive portion.

Item 79. The abrasive article of any of these items, wherein the back layer comprises clay, and a volume of clay within the back layer exceeds a volume of the discrete elastomeric particles within the back layer, wherein the back layer comprises at least about 2% clay, at least about 5%, at least about 10%, at least about 15%, wherein the back layer comprises not greater than about 25% clay, not greater than about 20%, not greater than about 15%, not greater than about 10%, or not greater than about 5%.

Item 80. The abrasive article of any of these items, wherein the back layer comprises a plurality of back layers, each of which comprises discrete elastomeric particles.

Item 81. The abrasive article of any of these items, wherein at least one of the plurality of back layers comprises a rubber-modified phenolic resin.

Item 82. The abrasive article of any of these items, wherein the discrete elastomeric particles may comprise a glass transition temperature (Tg) of less than about 100° C. For example, the Tg can be less than about 80° C., such as less than about 60° C., less than about 40° C., or even less than about 30° C. In other versions, the Tg can be at least about 10° C., such as at least about 20° C., at least about 30° C., at least about 40° C., or even at least about 50° C.

Item 83. The abrasive article of any of these items, wherein the back layer comprises at least about 2% clay, at least about 5%, at least about 10%, at least about 15%, not greater than about 25% clay, not greater than about 20%, not greater than about 15%, not greater than about 10%, or not greater than about 5% clay.

Item 84. The abrasive article of any of these items, wherein the back layer comprises clay, and a volume of clay within the back layer is less than a volume of the discrete elastomeric particles within the back layer, wherein the back layer has at least about 10% less clay than discrete elastomeric particles, at least about 25%, at least about 50%, or at least about 75% less clay than discrete elastomeric particles.

Item 85. The abrasive article of any of these items, wherein a volumetric ratio of microfibers to discrete elastomeric particles in the abrasive article comprises at least about 1:1, at least about 1.5:1, at least about 2:1, at least about 2.5:1, at least about 3:1, or at least about 5:1, and not greater than about 20:1, not greater than about 15:1, not greater than about 10:1, or not greater than about 5:1.

Item 86. The abrasive article of any of these items, wherein the microfibers comprise at least one of mineral fibers and carbon-based fibers.

Item 87. The abrasive article of any of these items, wherein the microfibers are mechanically milled microfibers.

Item 88. The abrasive article of any of these items, wherein the microfibers comprise milled carbon fibers.

Item 89. The abrasive article of any of these items, wherein the microfibers have an aspect ratio of length: diameter (L:D) of at least about 10, at least about 25, at least about 50, or at least about 75, and not greater than about 120, not greater than about 100, not greater than about 80, or not greater than about 60.

Item 90. The abrasive article of any of these items, wherein the abrasive portion comprises at least about 5 vol % of the microfibers, at least about 6 vol %, at least about 8 vol %, and not greater than about 20 vol %, not greater than about 15 vol %, or not greater than about 10 vol %.

Item 91. The abrasive article of any of these items, wherein the microfibers are dry blended into the abrasive portion.

Item 92. The abrasive article of any of these items, wherein both the discrete elastomeric particles are dry blended into a back formulation, and the microfibers are dry blended into the abrasive portion.

Item 93. A method of fabricating an abrasive article, comprising:

forming a molding compound (MC) that is non-abrasive and comprises a novolac phenolic resin having a melting temperature of less than about 90° C., and a solvent-free, liquid phenolic resin resole;

making an abrasive mix comprising an organic bond and abrasive particles;

placing the MC and the abrasive mix into a mold;

chopping a continuous strand yarn or roving into chopped strand fibers (CSF) having a primary coating and a secondary coating on the primary coating, and at least some of the CSF have a length of at least about 6.3 mm;

depositing the CSF in the mold with the abrasive mix; and then molding the abrasive article such that the CSF forms a reinforcement for the abrasive article.

Item 94. A method of fabricating an abrasive article, comprising:

forming an abrasive portion having an organic bond, abrasive particles and microfibers;

forming a back layer from a molding compound (MC) having discrete elastomeric particles and chopped strand fibers (CSF) having a thermoplastic coating having a loss on ignition (LOI) of at least about 2 wt %; and mounting the back layer to the abrasive portion to form the abrasive article.

Item 95. A method of fabricating an abrasive article, comprising:

forming an abrasive portion having an organic bond, abrasive particles and microfibers;

forming a back layer from molding compound (MC) that is non-abrasive and comprises chopped strand fibers (CSF), discrete elastomeric particles, a novolac phenolic resin having a melting temperature of less than about 90° C., and a solvent-free, liquid phenolic resin resole;

placing the back layer and the abrasive mix into a mold; and then pressurizing the back layer and abrasive mix to conform to the mold and form the abrasive article.

Item 96. The method of any of these items, wherein the continuous strand yarn or roving has a primary coating and, prior to chopping, further comprising applying a secondary coating on the primary coating.

Item 97. The method of any of these items, wherein chopping comprises chopping the CSF real time in-situ after forming and before molding.

Item 98. The method of any of these items, wherein the CSF are formed from a continuous strand yarn or roving, and further comprising chopping the continuous strand yarn or roving into CSF after making the abrasive portion and before molding.

Item 99. The method of any of these items, comprising distributing the CSF within at least a portion of the abrasive article.

Item 100. The method of any of these items, comprising placing a layer of the CSF adjacent the abrasive portion such that the abrasive article has a layered structure.

Item 101. The method of any of these items, wherein the MC is transferred to the mold either before or after addition of the abrasive mix, then the MC and abrasive mix are compression molded, and then the compression molding is subsequently cured in an oven.

Item 102. The method of any of these items, comprising forming the MC into a pre-preg that is solid, and placing the solid pre-preg in the mold.

Item 103. The method of any of these items, wherein the pre-preg is at least one of not fully cured and a material with a softening point below about 150° C.

Item 104. The method of any of these items, wherein the MC comprises at least one of bulk molding compound (BMC) and sheet molding compound (SMC).

Item 105. The method of any of these items, comprising forming SMC into a sheet.

Item 106. The method of any of these items, wherein the MC contains no abrasive particles having a MOHS scale hardness of greater than 9.

Item 107. The method of any of these items, wherein the abrasive article is not reinforced with a continuous glass web.

Item 108. The method of any of these items, wherein the abrasive article is reinforced with a continuous glass web.

Item 109. The method of any of these items, further comprising curing the abrasive article without the use of stacking plates.

Item 110. The method of any of these items, further comprising heating to sufficiently cure the abrasive article such that, after removal of the abrasive article from the mold, no subsequent curing is required.

Item 111. The method of any of these items, wherein the MC comprises at least one of hexamethylene tetramine (HMTA) and a novolac phenolic resin having a melting temperature of at least about 70° C., at least about 80° C., at least about 90° C., or at least about 100° C.

Item 112. The method of any of these items, wherein the MC is formed with high shear mixing.

Item 113. The method of any of these items, wherein the MC is formed in a range of about 60° C. to about 80° C.

Item 114. The method of any of these items, wherein the MC is a thermosetting composition.

Item 115. The method of any of these items, wherein the MC is solvent-free.

Item 116. The method of any of these items, comprising separately placing the MC and the abrasive mix into the mold.

Item 117. The method of any of these items, comprising at least one of injecting and dropping the MC and the abrasive mix into the mold cavity.

Item 118. The method of any of these items, further comprising chopping at least one of a continuous strand yarn and continuous strand roving into chopped strand fibers (CSF).

Item 119. The method of any of these items, further comprising pre-crosslinking the discrete elastomeric particles prior to forming the back layer.

Item 120. The method of any of these items, comprising molding the back layer onto the abrasive portion.

Item 121. The method of any of these items, further comprising mechanically pre-stressing the abrasive article.

Item 122. The method of any of these items, further comprising not mechanically pre-stressing the abrasive article.

Item 123. The method of any of these items, further comprising forming micro cracks in the abrasive portion.

Item 124. The method of any of these items, further comprising not forming micro cracks in the abrasive portion.

Item 125. The method of any of these items, wherein forming the abrasive portion comprises including microfibers in the abrasive portion.

Item 126. The method of any of these items, further comprising mechanically milling the microfibers.

Item 127. The method of any of these items, further comprising coating the microfibers.

Item 128. The method of any of these items, further comprising dry blending the microfibers into the abrasive portion.

Item 129. The method of any of these items, further comprising discrete elastomeric particles in the MC.

Item 130. The method of any of these items, further comprising dry blending the discrete elastomeric particles in the MC.

Item 131. An abrasive article, comprising:

an abrasive portion comprising an organic bond and abrasive particles; and a non-abrasive portion (NAP) mounted to the abrasive portion, the NAP comprising molding compound (MC) having no abrasive particles; and the abrasive article does not contain a continuous glass web to reinforce the abrasive article.

Item 132. An abrasive article, comprising:

an abrasive portion comprising an organic bond and abrasive particles; and a non-abrasive portion (NAP) mounted to the abrasive portion, the NAP comprising a molding compound (MC) having no abrasive particles with a MOHS scale hardness of at least about 9, the NAP has an outer diameter that is at least half of but not greater than an outer diameter of the abrasive article, and the NAP has an axial thickness that is at least about 7% of an overall axial thickness of the abrasive article, and not greater than about 50% of the overall axial thickness of the abrasive article.

Item 133. The abrasive article of any of these items, wherein the MC is at least one of a bulk molding compound (BMC) and a sheet molding compound (SMC).

Item 134. The abrasive article of any of these items, wherein the NAP has a MOHS scale hardness that is less than about 9, less than about 8, less than about 7, less than about 6, less than about 5, and at least about 1, at least about 2, at least about 3, or at least about 4.

Item 135. The abrasive article of any of these items, wherein the NAP and the abrasive portion have inner diameters and outer diameters that are substantially equal, respectively.

Item 136. The abrasive article of any of these items, wherein the NAP comprises a core and a back layer that is not a fine back layer, and the core and the back layer have a combined axial thickness that is not greater than the axial thickness of the abrasive article.

Item 137. The abrasive article of any of these items, wherein the back layer is contiguous with the core.

Item 138. The abrasive article of any of these items, wherein the back layer has an outer diameter that is greater than that of the core, the combined axial thickness of the back layer and the core is substantially equal to that of the abrasive article, and together the back layer and core form a unitary top hat structure.

Item 139. The abrasive article of any of these items, further comprising a fine back layer having abrasive particles and mounted to the abrasive portion.

Item 140. The abrasive article of any of these items, wherein the fine back layer has an outer diameter that is greater than that of the NAP.

Item 141. The abrasive article of any of these items, wherein the NAP and the fine back layer have inner and outer diameters that are, respectively, substantially equal.

Item 142. The abrasive article of any of these items, wherein the fine back layer has an axial thickness that is less than that of the NAP, and the NAP extends axially through both the abrasive portion and the fine back layer.

Item 143. The abrasive article of any of these items, wherein the fine back layer has an axial thickness that is substantially similar to that of the NAP, and the NAP extends axially only through the fine back layer and not through the abrasive portion.

Item 144. The abrasive article of any of these items, wherein the fine back layer has an inner diameter that is substantially equal to that of the NAP, and the NAP extends axially only through the abrasive portion and not through the fine back layer.

Item 145. The abrasive article of any of these items, wherein the abrasive portion comprises at least two layers, and the NAP is located axially between the at least two layers of the abrasive portion.

Item 146. The abrasive article of any of these items, wherein the abrasive article does not contain a continuous glass web to reinforce the abrasive article.

Item 147. The abrasive article of any of these items, wherein the abrasive article contains at least one continuous glass web to reinforce the abrasive article.

Item 148. The abrasive article of any of these items, wherein the NAP has an axial thickness that is greater than that of the continuous glass web.

Item 149. The abrasive article of any of these items, wherein the MC comprises at least one of a solvent-free, liquid phenolic resin resole, and a novolac phenolic resin having a melting temperature of less than about 90° C., less than about 80° C., less than about 75° C.

Item 150. The abrasive article of any of these items, wherein the abrasive portion is a grinding layer, and the NAP is bonded to the grinding layer.

Item 151. The abrasive article of any of these items, wherein the NAP comprises a solid, pre-formed core for the abrasive article.

Item 152. The abrasive article of any of these items, wherein a specific gravity of the MC is at least about 1.4, at least about 1.5, at least about 1.6, at least about 1.7, and not greater than about 1.9, not greater than about 1.8, or not greater than about 1.7.

Item 153. The abrasive article of any of these items 1-16 or 19-22, wherein the abrasive article consists exclusively of the abrasive portion and the NAP.

Item 154. The abrasive article of any of these items, wherein the NAP comprises at least one of porosity, chopped strand fibers (CSF), milled fibers, microfibers, organic fillers and inorganic fillers.

Item 155. The abrasive article of any of these items, wherein the MC is a thermosetting composition.

Item 156. The abrasive article of any of these items, wherein the NAP comprises chopped strand fibers (CSF), wherein the NAP comprises at least about 20 vol % CSF, at least about 25 vol %, at least about 30 vol %, at least about 35 vol %, and not greater than about 40 vol %, not greater than about 35 vol %, not greater than about 30 vol %, not greater than about 25 vol %.

Item 157. The abrasive article of any of these items, wherein the MC comprises at least one of hexamethylene tetramine (HMTA) and a novolac phenolic resin having a melting temperature of at least about 70° C., at least about 80° C., at least about 90° C., or at least about 100° C.

Item 158. The abrasive article of any of these items, wherein the NAP comprises chopped strand fibers (CSF), and the CSF comprises at least one of glass fibers, carbon fibers and aramid fibers.

Item 159. The abrasive article of any of these items, wherein the MC comprises a crosslinking agent comprising at least one of hexamethylene tetramine, multifunctional epoxy and polybenzoxazole (PBO).

Item 160. The abrasive article of any of these items, wherein the MC comprises a plurality of layers, each of which has an axial thickness that is less than that of a continuous glass web.

Item 161. The abrasive article of any of these items, wherein the MC has no abrasive particles with a MOHS scale hardness of about 10.

Item 162. A method of fabricating an abrasive article, comprising:

(a) forming a molding compound (MC) that is non-abrasive and comprises a novolac phenolic resin having a melting temperature of less than about 90° C., and a solvent-free, liquid phenolic resin resole;

(b) forming an abrasive matrix comprising an organic bond and abrasive particles;

(c) placing the MC and the abrasive matrix into a mold; and then (d) pressurizing the MC and abrasive matrix to conform to the mold and form the abrasive article.

Item 163. The method of any of these items, wherein the MC is transferred to the mold either before or after addition of the abrasive matrix, then the MC and abrasive matrix are compression molded, and then the compression molding is subsequently cured in an oven.

Item 164. The method of any of these items, wherein step (a) comprises forming the MC into a pre-preg that is solid, and step (c) comprises placing the solid pre-preg in the mold.

Item 165. The method of any of these items, wherein before step (d), the pre-preg is at least one of not fully cured and a material with a softening point below about 150° C.

Item 166. The method of any of these items, wherein the MC comprises at least one of bulk molding compound (BMC) and sheet molding compound (SMC).

Item 167. The method of any of these items, wherein forming comprises forming SMC into a sheet.

Item 168. The method of any of these items, wherein the MC contains no abrasive particles having a MOHS scale hardness of greater than 9.

Item 169. The method of any of these items, further comprising adding chopped strand fibers (CSF).

Item 170. The method of any of these items, wherein forming comprises mixing the CSF into the MC.

Item 171. The method of any of these items, wherein placing comprises forming a layer of the CSF between the MC and the abrasive matrix.

Item 172. The method of any of these items, wherein the abrasive article is not reinforced with a continuous glass web.

Item 173. The method of any of these items, wherein the abrasive article is reinforced with a continuous glass web.

Item 174. The method of any of these items, further comprising applying heat to the MC during at least one of steps (a) and (c).

Item 175. The method of any of these items, further comprising removing the abrasive article from the mold, and then curing the abrasive article without the use of stacking plates.

Item 176. The method of any of these items, wherein pressurizing further comprises heating to sufficiently cure the abrasive article such that, after removal of the abrasive article from the mold, no subsequent curing is required.

Item 177. The method of any of these items, wherein the MC comprises at least one of hexamethylene tetramine (HMTA) and a novolac phenolic resin having a melting temperature of at least about 70° C., at least about 80° C., at least about 90° C., or at least about 100° C.

Item 178. The method of any of these items, wherein the MC is formed with high shear mixing.

Item 179. The method of any of these items, wherein the MC is formed in a range of about 60° C. to about 80° C.

Item 180. The method of any of these items, wherein the MC is a thermosetting composition.

Item 181. The method of any of these items, wherein the MC is solvent-free.

Item 182. The method of any of these items, wherein step (c) comprises separately placing the MC and the abrasive matrix into the mold cavity.

Item 183. The method of any of these items, wherein step (c) comprises at least one of injecting and dropping the MC and the abrasive matrix into the mold cavity.

Item 184. The method of any of these items, further comprising chopping at least one of a continuous strand yarn and continuous strand roving into chopped strand fibers (CSF).

Item 185. The method of any of these items, wherein step (c) comprises placing a layer of the CSF in the mold with the MC and the abrasive matrix; and step (d) comprises molding the abrasive article such that the CSF forms a reinforcement layer for the abrasive article.

Item 186. The method of any of these items, further comprising mixing the CSF with the MC prior to step (c).

Item 187. An abrasive article, comprising:

an abrasive portion having an organic bond and abrasive particles; and a back layer mounted to the abrasive portion, and the back layer comprises discrete elastomeric particles.

Item 188. The abrasive article of any of these items, wherein the discrete elastomeric particles are rubber particles or pre-crosslinked rubber particles.

Item 189. The abrasive article of any of these items, wherein the discrete elastomeric particles are not rubber-modified phenolic resin.

Item 190. The abrasive article of any of these items, wherein the abrasive article is a flexible wheel that is axially deflectable at a perimeter thereof without damaging the abrasive article.

Item 191. The abrasive article of any of these items, wherein the abrasive article has a flexibility that is at least about 5% lower than that of a conventional abrasive article, at least about 10% lower, at least about 20% lower, at least about 30% lower, at least about 40% lower, at least about 50% lower, at least about 60% lower, at least about 70% lower, at least about 80% lower, at least about 90% lower than that of the conventional abrasive article, and not greater than about 200% lower than that of the conventional abrasive article, not greater than about 150% lower, or not greater than about 125% lower than that of the conventional abrasive article.

Item 192. The abrasive article of any of these items wherein, for up to about 5 mm of deflection and when pre-stressed, the abrasive article has a flexibility that is at least about 6.5 mm/kN, at least about 8 mm/kN, at least about 10 mm/kN, at least about 12 mm/kN, and not greater than about 20 mm/kN, not greater than about 15 mm/kN, or not greater than about 13 mm/kN.

Item 193. The abrasive article of any of these items wherein, for up to about 5 mm of initial deflection without pre-stress, the abrasive article has a flexibility that is at least about 2.75 mm/kN, at least about 3 mm/kN, at least about 3.25 mm/kN, at least about 3.5 mm/kN, and not greater than about 5 mm/kN, not greater than about 4 mm/kN, or not greater than about 3.75 mm/kN.

Item 194. The abrasive article of any of these items, wherein the back layer comprises abrasive particles.

Item 195. The abrasive article of any of these items, wherein the back layer comprises at least about 25 vol % of the abrasive article, at least about 30 vol %, at least about 35 vol %, at least about 40 vol % of the abrasive article, and not greater than about 50 vol % of the abrasive article, not greater than about 45 vol %, or not greater than about 40 vol % of the abrasive article.

Item 196. The abrasive article of any of these items, wherein the discrete elastomeric particles have a average particle size of at least about 1 micron, at least about 5 microns, at least about 10 microns, at least about 15 microns, at least about 20 microns, at least about 25 microns, at least about 30 microns, and not greater than about 60 microns, not greater than about 50 microns, not greater than about 45 microns, not greater than about 40 microns, or not greater than about 35 microns.

Item 197. The abrasive article of any of these items, wherein the discrete elastomeric particles comprise at least about 10 vol % of the back layer, at least about 15 vol %, at least about 20 vol %, and not greater than about 30 vol %, not greater than about 25 vol %, or not greater than about 20 vol % of the back layer.

Item 198. The abrasive article of any of these items, wherein the discrete elastomeric particles are dry blended into a back formulation.

Item 199. The abrasive article of any of these items, wherein the back layer is molded onto the abrasive portion of the abrasive article.

Item 200. The abrasive article of any of these items, wherein the abrasive article is mechanically pre-stressed.

Item 201. The abrasive article of any of these items, wherein the abrasive article is not mechanically pre-stressed.

Item 202. The abrasive article of any of these items, wherein the abrasive article comprises micro cracks in the abrasive portion.

Item 203. The abrasive article of any of these items, wherein the abrasive article does not have micro cracks in the abrasive portion.

Item 204. The abrasive article of any of these items, wherein the back layer comprises clay, and a volume of clay within the back layer exceeds a volume of the discrete elastomeric particles within the back layer, wherein the back layer comprises at least about 2% clay, at least about 5%, at least about 10%, at least about 15%, wherein the back layer comprises not greater than about 25% clay, not greater than about 20%, not greater than about 15%, not greater than about 10%, or not greater than about 5%.

Item 205. The abrasive article of any of these items, wherein the back layer comprises a plurality of back layers, each of which comprises discrete elastomeric particles.

Item 206. The abrasive article of any of these items, wherein at least one of the plurality of back layers comprises a rubber-modified phenolic resin.

Item 207. The abrasive article of any of these items, wherein the discrete elastomeric particles may comprise a glass transition temperature (Tg) of less than about 100° C. For example, the Tg can be less than about 80° C., such as less than about 60° C., less than about 40° C., or even less than about 30° C. In other versions, the Tg can be at least about 10° C., such as at least about 20° C., at least about 30° C., at least about 40° C., or even at least about 50° C.

Item 208. The abrasive article of any of these items, wherein the back layer comprises at least about 2% clay, at least about 5%, at least about 10%, at least about 15%, not greater than about 25% clay, not greater than about 20%, not greater than about 15%, not greater than about 10%, or not greater than about 5% clay.

Item 209. A method of fabricating an abrasive article, comprising:

forming an abrasive portion having an organic bond and abrasive particles;

forming a back layer having discrete elastomeric particles; and mounting the back layer to the abrasive portion to form the abrasive article.

Item 210. The method of any of these items, further comprising pre-crosslinking the discrete elastomeric particles prior to forming the back layer.

Item 211. The method of any of these items, wherein mounting comprises molding the back layer onto the abrasive portion.

Item 212. The method of any of these items, further comprising mechanically pre-stressing the abrasive article.

Item 213. The method of any of these items, further comprising not mechanically pre-stressing the abrasive article.

Item 214. The method of any of these items, further comprising forming micro cracks in the abrasive portion.

Item 215. The method of any of these items, further comprising not forming micro cracks in the abrasive portion.

Item 216. The method of any of these items, further comprising dry blending the discrete elastomeric particles into a back formulation.

Item 217. An abrasive article, comprising:

an abrasive portion having an organic bond, abrasive particles and microfibers; and a back layer mounted to the abrasive portion, and the back layer comprises discrete elastomeric particles.

Item 218. The abrasive article of any of these items, wherein the discrete elastomeric particles are rubber particles or pre-crosslinked rubber particles.

Item 219. The abrasive article of any of these items, wherein the discrete elastomeric particles are not rubber-modified phenolic resin.

Item 220. The abrasive article of any of these items, wherein the abrasive article is a flexible wheel that is axially deflectable at a perimeter thereof without damaging the abrasive article.

Item 221. The abrasive article of any of these items, wherein the abrasive article has a flexibility that is at least about 5% lower than that of a conventional abrasive article, at least about 10% lower, at least about 20% lower, at least about 30% lower, at least about 40% lower, at least about 50% lower, at least about 60% lower, at least about 70% lower, at least about 80% lower, at least about 90% lower than that of the conventional abrasive article, and not greater than about 200% lower than that of the conventional abrasive article, not greater than about 150% lower, or not greater than about 125% lower than that of the conventional abrasive article.

Item 222. The abrasive article of any of these items wherein, for up to about 5 mm of deflection and when pre-stressed, the abrasive article has a flexibility that is at least about 6.5 mm/kN, at least about 8 mm/kN, at least about 10 mm/kN, at least about 12 mm/kN, and not greater than about 20 mm/kN, not greater than about 15 mm/kN, or not greater than about 13 mm/kN.

Item 223. The abrasive article of any of these items wherein, for up to about 5 mm of initial deflection without pre-stress, the abrasive article has a flexibility that is at least about 2.75 mm/kN, at least about 3 mm/kN, at least about 3.25 mm/kN, at least about 3.5 mm/kN, and not greater than about 5 mm/kN, not greater than about 4 mm/kN, or not greater than about 3.75 mm/kN.

Item 224. The abrasive article of any of these items, wherein the back layer comprises abrasive particles.

Item 225. The abrasive article of any of these items, wherein the back layer comprises at least about 25 vol % of the abrasive article, at least about 30 vol %, at least about 35 vol %, at least about 40 vol % of the abrasive article, and not greater than about 50 vol % of the abrasive article, not greater than about 45 vol %, or not greater than about 40 vol % of the abrasive article.

Item 226. The abrasive article of any of these items, wherein the discrete elastomeric particles have a average particle size of at least about 1 micron, at least about 5 microns, at least about 10 microns, at least about 15 microns, at least about 20 microns, at least about 25 microns, at least about 30 microns, and not greater than about 60 microns, not greater than about 50 microns, not greater than about 45 microns, not greater than about 40 microns, or not greater than about 35 microns.

Item 227. The abrasive article of any of these items, wherein the discrete elastomeric particles comprise at least about 10 vol % of the back layer, at least about 15 vol %, at least about 20 vol %, and not greater than about 30 vol %, not greater than about 25 vol %, or not greater than about 20 vol % of the back layer.

Item 228. The abrasive article of any of these items, wherein the discrete elastomeric particles are dry blended into a back formulation.

Item 229. The abrasive article of any of these items, wherein the back layer is molded onto the abrasive portion of the abrasive article.

Item 230. The abrasive article of any of these items, wherein the abrasive article is mechanically pre-stressed.

Item 231. The abrasive article of any of these items, wherein the abrasive article is not mechanically pre-stressed.

Item 232. The abrasive article of any of these items, wherein the abrasive article comprises micro cracks in the abrasive portion.

Item 233. The abrasive article of any of these items, wherein the abrasive article does not have micro cracks in the abrasive portion.

Item 234. The abrasive article of any of these items, wherein the back layer comprises clay, and a volume of clay within the back layer exceeds a volume of the discrete elastomeric particles within the back layer, wherein the back layer comprises at least about 2% clay, at least about 5%, at least about 10%, at least about 15%, wherein the back layer comprises not greater than about 25% clay, not greater than about 20%, not greater than about 15%, not greater than about 10%, or not greater than about 5%.

Item 235. The abrasive article of any of these items, wherein the back layer comprises a plurality of back layers, each of which comprises discrete elastomeric particles.

Item 236. The abrasive article of any of these items, wherein at least one of the plurality of back layers comprises a rubber-modified phenolic resin.

Item 237. The abrasive article of any of these items, wherein the discrete elastomeric particles may comprise a glass transition temperature (Tg) of less than about 100° C. For example, the Tg can be less than about 80° C., such as less than about 60° C., less than about 40° C., or even less than about 30° C. In other versions, the Tg can be at least about 10° C., such as at least about 20° C., at least about 30° C., at least about 40° C., or even at least about 50° C.

Item 238. The abrasive article of any of these items, wherein the back layer comprises at least about 2% clay, at least about 5%, at least about 10%, at least about 15%, not greater than about 25% clay, not greater than about 20%, not greater than about 15%, not greater than about 10%, or not greater than about 5% clay.

Item 239. The abrasive article of any of these items, wherein the back layer comprises clay, and a volume of clay within the back layer is less than a volume of the discrete elastomeric particles within the back layer, wherein the back layer has at least about 10% less clay than discrete elastomeric particles, at least about 25%, at least about 50%, or at least about 75% less clay than discrete elastomeric particles.

Item 240. The abrasive article of any of these items, wherein a volumetric ratio of microfibers to discrete elastomeric particles in the abrasive article comprises at least about 1:1, at least about 1.5:1, at least about 2:1, at least about 2.5:1, at least about 3:1, or at least about 5:1, and not greater than about 20:1, not greater than about 15:1, not greater than about 10:1, or not greater than about 5:1.

Item 241. The abrasive article of any of these items, wherein the microfibers comprise at least one of mineral fibers and carbon-based fibers.

Item 242. The abrasive article of any of these items, wherein the microfibers are mechanically milled microfibers.

Item 243. The abrasive article of any of these items, wherein the microfibers comprise milled carbon fibers.

Item 244. The abrasive article of any of these items, wherein the microfibers have an aspect ratio of length: diameter (L:D) of at least about 10, at least about 25, at least about 50, or at least about 75, and not greater than about 120, not greater than about 100, not greater than about 80, or not greater than about 60.

Item 245. The abrasive article of any of these items, wherein the abrasive portion comprises at least about 5 vol % of the microfibers, at least about 6 vol %, at least about 8 vol %, and not greater than about 20 vol %, not greater than about 15 vol %, or not greater than about 10 vol %.

Item 246. The abrasive article of any of these items, wherein the microfibers are dry blended into the abrasive portion.

Item 247. The abrasive article of any of these items, wherein both the discrete elastomeric particles are dry blended into a back formulation, and the microfibers are dry blended into the abrasive portion.

Item 248. A method of fabricating an abrasive article, comprising:

forming an abrasive portion having an organic bond, abrasive particles and microfibers;

forming a back layer having discrete elastomeric particles; and mounting the back layer to the abrasive portion to form the abrasive article.

Item 249. The method of any of these items, further comprising pre-crosslinking the discrete elastomeric particles prior to forming the back layer.

Item 250. The method of any of these items, wherein mounting comprises molding the back layer onto the abrasive portion.

Item 251. The method of any of these items, further comprising mechanically pre-stressing the abrasive article.

Item 252. The method of any of these items, further comprising not mechanically pre-stressing the abrasive article.

Item 253. The method of any of these items, further comprising forming micro cracks in the abrasive portion.

Item 254. The method of any of these items, further comprising not forming micro cracks in the abrasive portion.

Item 255. The method of any of these items, wherein forming the abrasive portion comprises including microfibers in the abrasive portion.

Item 256. The method of any of these items, further comprising mechanically milling the microfibers.

Item 257. The method of any of these items, further comprising coating the microfibers.

Item 258. The method of any of these items, further comprising dry blending the microfibers into the abrasive portion.

Item 259. The method of any of these items, further comprising dry blending the discrete elastomeric particles into a back formulation.

Item 260. An abrasive article, comprising:

an abrasive portion having an organic bond and abrasive particles; and a reinforcement comprising chopped strand fibers (CSF) coated with a thermoplastic coating having a loss on ignition (LOI) of at least about 2.4 wt %.

Item 261. An abrasive article, comprising:

an abrasive portion having an organic bond and abrasive particles; and a reinforcement comprising chopped strand fibers (CSF) coated with a primary coating and a secondary coating on the primary coating.

Item 262. An abrasive article, comprising:

an abrasive portion having an organic bond and abrasive particles; and a reinforcement comprising chopped strand fibers (CSF), at least some of which have a length of at least about 6.3 mm.

Item 263. An abrasive article, comprising:

an abrasive portion having an organic bond and abrasive particles;

a reinforcement comprising chopped strand fibers (CSF); and the abrasive article has a work of fracture (wof) that is at least about 1% greater than that of a conventional abrasive article (CAA), and the CAA comprises at least one of:

(a) CSF with a coating having an LOI of less than 2 wt %;

(b) CSF without a secondary coating; and (c) CSF having a length of less than 6.3 mm.

Item 264. The abrasive article of any of these items, wherein the CSF has a primary coating and the thermoplastic coating is a secondary coating on the primary coating.

Item 265. The abrasive article of any of these items, wherein the CSF further comprises a direct sized coating, and the thermoplastic coating is a secondary coating on the direct sized coating.

Item 266. The abrasive article of any of these items, wherein the direct sized coating has an LOI of less than about 2 wt %.

Item 267. The abrasive article of any of these items, wherein the CSF comprises a yield in a range of about 134 TEX (3700 yd/lb) to about 1830 TEX (271 yd/lb).

Item 268. The abrasive article of any of these items, wherein the CSF comprises a yield of at least 125 TEX, at least 250 TEX, at least 500 TEX, at least 750 TEX, at least 1000 TEX, at least 1500 TEX, and not greater than about 2000 TEX, not greater than about 1500 TEX, not greater than about 1000 TEX, not greater than about 750 TEX, not greater than about 500 TEX, not greater than about 250 TEX.

Item 269. The abrasive article of any of these items, wherein the abrasive article does not have a continuous fiber reinforcement, such that the abrasive article is reinforced only by the CSF.

Item 270. The abrasive article of any of these items, wherein the CSF have a maximum length, and at least some of the CSF are within about 10% of the maximum length, within about 5% of the maximum length, about 90% of the CSF are within about 10% of the maximum length, about 95% of the CSF are within about 10% of the maximum length, or about 95% of the CSF are within about 5% of the maximum length.

Item 271. The abrasive article of any of these items, wherein a length of at least some of the CSF is at least about 6.3 mm, at least about 7 mm, at least about 8 mm, at least about 10 mm, at least about 12 mm, at least about 15 mm, at least about 20 mm, and not greater than about 125 mm, not greater than about 100 mm, not greater than about 75 mm, not greater than about 50 mm, not greater than about 40 mm, or not greater than about 30 mm.

Item 272. The abrasive article of any of these items, wherein the coating comprises a high hydrogen-bonding capacity polymer, wherein the thermoplastic coating comprises a thermoplastic polymer -(A-B)— made with monomers A and B, where the B segment of the polymer contains at least 2-XHn functionalities, where X=O or N or S, and n=1 or 2.

Item 273. The abrasive article of any of these items, wherein the CSF have a coating comprising at least one of a thermoplastic, thermoplastic novolac, phenoxy, polyurethane, or any combination thereof.

Item 274. The abrasive article of any of these items, wherein the coating is substantially not cross-linked.

Item 275. The abrasive article of any of these items, wherein less than about 5% of the coating is cross-linked.

Item 276. The abrasive article of any of these items, wherein the coating comprises a LOI of at least about 2 wt %, at least about 3 wt %, at least about 5 wt %, at least about 7 wt %, at least about 9 wt %, at least about 12 wt %, at least about 15 wt %, and not greater than about 25 wt %, not greater than about 20 wt %, not greater than about 15 wt %, or not greater than about 12 wt %.

Item 277. The abrasive article of any of these items, wherein the abrasive article has a work of fracture (wof) that is at least about 1% greater than that of a conventional abrasive article (CAA), at least about 2% greater, at least about 3% greater, at least about 5% greater, at least about 7% greater, or at least about 10% greater than that of the CAA, and the CAA comprises:

(a) CSF with a coating having an LOI of less than 2 wt %;

(b) CSF without a secondary coating; or (d) CSF having a length of less than 6.3 mm.

Item 278. The abrasive article of any of these items wherein, compared to a conventional abrasive article (CAA) reinforced with a continuous fiber web and no CSF, the abrasive article has:

a work of fracture (Wof) that is within about 5% of that of the CAA, within about 10%, or within about 15% of that of the CAA.

Item 279. The abrasive article of any of these items wherein, compared to a conventional abrasive article (CAA) reinforced with a continuous fiber web and no CSF, the abrasive article has:

a strength (psi) that is within about 1% of that of the CAA, within about 5%, or within about 10% of that of the CAA.

Item 280. The abrasive article of any of these items wherein, compared to a conventional abrasive article (CAA) reinforced with a continuous fiber web and no CSF, the abrasive article has:

a toughness (G1C) that is within about 1% of that of the CAA, within about 5%, or within about 10% of that of the CAA.

Item 281. The abrasive article of any of these items, wherein the CSF are dispersed in at least a portion of the abrasive article.

Item 282. The abrasive article of any of these items, wherein the CSF are substantially randomly distributed throughout the abrasive portion.

Item 283. The abrasive article of any of these items, wherein the abrasive article has an axial thickness, and the CSF has a maximum length that is not greater than the axial thickness.

Item 284. The abrasive article of any of these items, wherein the CSF are formed as a discrete layer in the abrasive mix.

Item 285. The abrasive article of any of these items, wherein the discrete layer of comprises a plurality of discrete layers that are axially separated from each other by portions of the abrasive mix.

Item 286. The abrasive article of any of these items, wherein the discrete layer is a sintered mat of the CSF such that the CSF are integral.

Item 287. The abrasive article of any of these items, wherein the abrasive article is a wheel having an axis, an outer diameter (OD) and an inner diameter (ID), and a maximum length of the CSF is not greater than (OD−ID)/2.

Item 288. The abrasive article of any of these items, wherein the abrasive article further comprises at least one web formed from continuous fiber reinforcement, such that the abrasive body is reinforced by the CSF and the web.

Item 289. The abrasive article of any of these items, wherein the abrasive article comprises a volume percentage of the CSF of at least about 1 vol %, at least about 2 vol %, at least about 3 vol %, at least about 4 vol %, at least about 5 vol %, at least about 6 vol %, at least about 9 vol %, and not greater than about 25 vol %, not greater than about 20 vol %, not greater than about 15 vol %.

Item 290. The abrasive article of any of these items, wherein the abrasive article comprises about 25 vol % to about 50 vol % of the organic bond, about 40 vol % to about 70 vol % of the abrasive particles, and about 6 vol % to about 12 vol % of the CSF.

Item 291. A method of fabricating an abrasive article, comprising:

making an abrasive mix comprising an organic bond and abrasive particles;

forming the abrasive mix into a shape of an abrasive article in a mold;

chopping a continuous strand yarn or roving into chopped strand fibers (CSF), at least some of which have a length of at least about 6.3 mm;

depositing the CSF in the mold with the abrasive mix; and then molding the abrasive article such that the CSF forms a reinforcement for the abrasive article.

Item 292. The method of any of these items, wherein the continuous strand yarn or roving has a primary coating and, prior to chopping, further comprising applying a secondary coating on the primary coating.

Item 293. The method of any of these items, wherein chopping comprises chopping the CSF real time in-situ after forming and before molding.

Item 294. A method of fabricating an abrasive article, comprising:

making an abrasive portion comprising an organic bond and abrasive particles;

reinforcing the abrasive article with chopped strand fibers (CSF) coated with a thermoplastic coating having a loss on ignition (LOI) of at least about 2 wt %; and molding the abrasive portion and CSF to form the abrasive article.

Item 295. A method of fabricating an abrasive article, comprising:

making an abrasive portion comprising an organic bond and abrasive particles;

reinforcing the abrasive article with chopped strand fibers (CSF) coated with a primary coating and a secondary coating on the primary coating; and molding the abrasive portion and CSF to form the abrasive article.

Item 296. A method of fabricating an abrasive article, comprising:

making an abrasive portion comprising an organic bond and abrasive particles;

reinforcing the abrasive article with chopped strand fibers (CSF), at least some of which have a length of at least about 6.3 mm; and molding the abrasive portion and CSF to form the abrasive article.

Item 297. The method of any of these items, wherein the CSF are provided as a continuous strand, yarn or roving, and further comprising chopping the continuous strand yarn or roving into CSF after making the abrasive portion and before molding.

Item 298. The method of any of these items, wherein reinforcing comprises mixing the CSF with at least a portion of the abrasive article such that the CSF are distributed within the abrasive article.

Item 299. The method of any of these items, wherein reinforcing comprises placing a layer of the CSF adjacent the abrasive portion such that the abrasive article has a layered structure.

Item 300. An abrasive article, comprising:

an abrasive portion comprising an organic bond and abrasive particles; and a non-abrasive portion (NAP) coupled to the abrasive portion, the NAP comprising molding compound (MC) having no abrasive particles with a MOHS scale hardness greater than about 9.

The NAP can be an integral part of the wheel, i.e., it melts/flows and chemically reacts with the grinding zone as opposed to mechanically or adhesively bonding two dissimilar materials.

Item 301. The abrasive article of item 300, wherein the NAP extends from a peripheral center of the wheel and has a diameter of not less than 30% of a diameter of the abrasive portion.

Item 302. The abrasive article of item 300, wherein the NAP has an axial thickness of not less than about 30% of an overall axial thickness of the abrasive article.

Item 303. The abrasive article of item 300, wherein the NAP comprises a core and a back layer, and the core and the back layer have a combined axial thickness that is not greater than an overall axial thickness of the abrasive article.

Item 304. The abrasive article of item 300, wherein the MC comprises a thermosetting phenolic material with a room temperature viscosity of 1 to 2 million pascal-sec, and 0.05 to 0.2 pascal-sec at 100° C., and subsequently cures reaching a maximum viscosity above 125° C.

Item 305. The abrasive article of item 300, wherein the NAP comprises at least one reinforcement comprising a continuous fiber mat, needled fiber mat, continuous glass web, chopped strand glass fibers (CSF), chopped carbon fibers, chopped aramid fibers, chopped polymer fibers, milled fibers, microfibers, and an inorganic filler having an aspect ratio greater than 1, or any combination thereof.

Item 306. The abrasive article of item 300, wherein the MC comprises at least one curing additive comprising hexamethylene tetramine (HMTA), polybenzoxazole (PBO), paraformaldehyde, melamine-formaldehyde resin, phenols or resorcinol with methylol functionality, multifunctional epoxy, cyanate esters, multifunctional isocyanate or any combination thereof.

Item 307. The abrasive article of item 300, wherein the MC comprises at least one rubber material, elastomeric material, thermoplastic material or any combination thereof.

Item 308. The abrasive article of item 300, wherein the NAP comprises chopped strand fibers (CSF), and the NAP comprises at least about 20 vol % CSF and not greater than about 40 vol %.

Item 309. The abrasive article of item 300, further comprising chopped strand fibers (CSF) coated with a thermoplastic coating having a loss on ignition (LOI) of at least about 2.4 wt %.

Item 310. The abrasive article of item 300, further comprising a back layer mounted to the abrasive portion, and the back layer comprises discrete elastomeric particles and chopped strand fibers (CSF), and at least some of the CSF have a length of at least about 6.3 mm.

Item 311. The abrasive article of item 300, wherein the abrasive portion comprises microfibers.

Item 312. The abrasive article of item 309, wherein the CSF has a primary coating and a coating comprising at least one of a thermoplastic, thermoplastic novolac, phenoxy, polyurethane, or any combination thereof.

Item 313. The abrasive article of item 312, wherein the CSF further comprises a direct sized coating, and the thermoplastic coating is a secondary coating on the direct sized coating.

Item 314. The abrasive article of item 313, wherein the direct sized coating has a loss on ignition (LOI) of less than about 2 wt %.

Item 315. A method of fabricating an abrasive article, comprising:

(a) forming a molding compound (MC) that is non-abrasive and uncured, wherein the MC comprises a thermosetting phenolic material with a room temperature viscosity of 1 to 2 million pascal-sec, and 0.05 to 0.2 pascal-sec at 100° C., and subsequently cures reaching a maximum viscosity above 125° C.;

(b) forming an abrasive matrix comprising an organic bond and abrasive particles;

(c) sequentially transferring the MC and the abrasive matrix into a mold; and then (d) pressurizing the MC and abrasive matrix to conform to the mold and form the abrasive article.

Item 316. The method of item 315, wherein the MC is transferred to the mold either before or after addition of the abrasive matrix, then the MC and abrasive matrix are compression molded, and then the compression molding is subsequently cured in an oven.

Item 317. The method of item 315, wherein step (a) comprises forming the MC into a pre-preg that is solid, and step (c) comprises placing the solid pre-preg in the mold.

Item 318. The method of item 317, wherein before step (d), the pre-preg is at least one of not fully cured and a material with a softening point below about 150° C.

Item 319. The method of item 315, further comprising adding chopped strand fibers (CSF).

Item 320. The method of item 319, wherein forming comprises mixing the CSF into the MC.

Item 321. The method of item 315, further comprising applying heat to the MC during at least one of steps (a) and (c).

Item 322. The method of item 315, wherein pressurizing further comprises heating to sufficiently cure the abrasive article such that, after removal of the abrasive article from the mold, no subsequent curing is required.

Item 323. The method of item 315, wherein step (c) comprises separately placing the MC and the abrasive matrix into the mold cavity.

Item 324. The method of item 315, wherein step (c) comprises at least one of injecting and dropping the MC and the abrasive matrix into the mold cavity.

Item 325. A method of fabricating an abrasive article, comprising:

(a) forming a molding compound (MC) into an uncured, non-abrasive portion (NAP), wherein the MC comprises a thermosetting phenolic material with a room temperature viscosity of 1 to 2 million pascal-sec, and 0.05 to 0.2 pascal-sec at 100° C., and subsequently cures reaching a maximum viscosity above 125° C.;

(b) forming an abrasive matrix comprising an organic bond and abrasive particles;

(c) sequentially transferring the MC and the abrasive matrix into a mold; and then (d) pressurizing the MC and abrasive matrix to conform to the mold and form the abrasive article.

EXAMPLES

Example 1

Each sample of the abrasive composite wheel compositions comprised 57 vol % bond and 38-40 vol % abrasive. In addition, a small amount of furfural (about 1 vol %) or less was used to wet the abrasive particles. The bonds were blended with the furfural-wetted abrasive followed by addition of the reinforcements with only minimal mixing thereafter. The compositions were allowed to age for at least 2 hours before molding. Each mixture was pre-weighed then transferred into a 203 mm diameter mold, spread and then hot pressed at 160° C. for 45 minutes under 352 kg/cm$^2$. The wheels were removed from the mold and additionally cured at 200° C. for 18 hours. Flexural specimens having the correct dimensions according to ASTM procedure D790-03 were cut from the wheel and tested in a three point bend with a 5:1 span to depth ratio. Additional specimens having the same dimensions and having a notch across the specimen width were tested according to procedure described above. The formulations for these samples appear in Table 1.

TABLE 1

| | | Vol % Identification Number | | | | | |
|---|---|---|---|---|---|---|---|
| | Material | 1 | 7 | 3 | 4 | 5 | 6 |
| Abrasive component | Brown fused alumina-60 grit | 0.2 | 0.2 | 0.2 | 0.2 | 0.19 | 0.19 |
| | Silicon carbide-60 grit | 0.2 | 0.2 | 0.2 | 0.2 | 0.19 | 0.19 |
| Bond | Durez 29344 resin | 0.34 | 0.34 | 0.34 | 0.34 | 0.34 | 0.34 |
| | silicon carbide-600 grit | 0.07 | 0.07 | 0.07 | 0.07 | 0.07 | 0.07 |
| | silicon carbide-220 grit | 0.13 | 0.13 | 0.13 | 0.13 | 0.13 | 0.13 |
| | Lime | 0.03 | 0.03 | 0.03 | 0.03 | 0.03 | 0.03 |
| Reinforcement | OC183-4 mm length | 0.03 | | | | | |
| | OC983-4 mm length | | 0.03 | | | | |

TABLE 1-continued

| Material | Vol % Identification Number 1 | 7 | 3 | 4 | 5 | 6 |
|---|---|---|---|---|---|---|
| PUD (2.4% LOI) coated yarn-12.5 mm length | | | 0.03 | | 0.045 | |
| PUD (9% LOI) coated yarn-12.5 mm length | | | | 0.03 | | 0.045 |
| Average Strength (psil) | 92.5 | 102.3 | 114.7 | 95.8 | 110.6 | 86.4 |
| Average Modulus (psi) | 13584 | 14090 | 14495 | 13049 | 13784 | 12776 |
| Average SpWoF | 1859 | 1485 | 1048 | 1927 | 1117 | 2527 |
| Average G1c | 753 | 699 | 840 | 744 | 839 | 844 |
| Sp WoF Specimen values | 1930 | 1991 | 709 | 2104 | 1438 | 2210 |
| | 3250 | 877 | 758 | 1787 | 934 | 1853 |
| | 2545 | 1529 | 1455 | 1782 | 930 | 2180 |
| | 1481 | 1294 | 1252 | 1901 | 835 | 1998 |
| | 1495 | 1078 | 1302 | 1848 | 817 | 3005 |
| | 1763 | 2599 | 717 | 2153 | 1397 | 3557 |
| | 1381 | 1054 | 1344 | 1761 | 1695 | 1440 |
| | 1030 | 1457 | 849 | 2079 | 892 | 3976 |
| Gic Specimen values | 720 | 672 | 876 | 675 | 975 | 1260 |
| | 917 | 741 | 678 | 728 | 901 | 811 |
| | 793 | 706 | 1022 | 928 | 692 | 784 |
| | 701 | 644 | 998 | 666 | 853 | 794 |
| | 908 | 689 | 827 | 716 | 707 | 738 |
| | 588 | 761 | 857 | 756 | 852 | 1049 |
| | 727 | 686 | 680 | 806 | 998 | 629 |
| | 670 | 696 | 780 | 675 | 730 | 690 |

Each wheel was tested for strength (psi), toughness ($G_{1C}$) and work of fracture (wof). Strength, wof and toughness were measured parallel to the direction in which the wheel was pressed.

As depicted in Table 1, sample "PUD (9% LOI)" had an average strength of 95.8 psi, while sample "PUD (2.4% LOI)" had an average strength of 114.7 psi. These values compare favorably to the average strengths (92.5 psi and 102.3 psi, respectively) of the two conventional samples "OC183" and "OC983". The strength of the new samples exceeded or were within about 10% of the strengths of the conventional samples.

Regarding modulus, sample "PUD (9% LOI)" had an average modulus of 13049 psi, while sample "PUD (2.4% LOI)" had an average strength of 14495 psi. These values compare favorably to the average modulus (13584 psi and 14090 psi, respectively) of the two conventional samples. The modulus of the new samples exceeded or were within about 8% of the modulus of the conventional samples.

Regarding work of fracture (wof), sample "PUD (9% LOI)" had an average wof of 1927, while sample "PUD (2.4% LOI)" had an average wof of 1048. These values compare favorably to the average Wof (1859 and 1485, respectively) of the two conventional samples. The Wof of the new samples exceeded or were within about 45% of the Wof of the conventional samples.

Thus, in some versions, as LOI increases for the thermoplastic-coated reinforcement, strength decreases but Wof increases. An LOI of about 9 wt % achieves both strength and Wof that is not achievable by conventional chopped strands. This performance may be further enhanced by adding additional chopped coated strands (e.g., 4.5 vol %).

Example 2

In another experiment, various types of CSF sample wheels were prepared in accordance with Table 2A. Some of the samples were coated, while others were not. These samples did not contain conventional web reinforcements. The samples otherwise were prepared in an identical manner as described in Example 1. As described in Table 2A, the samples in FIG. 9 contained various volumes and sizes, and some included thermoplastic (polyurethane) coatings. Each sample had an LOI of about 15 wt % to about 25 wt %.

TABLE 2A

| Component | 07100201 | 07100202 | 07100203 | 7110601 | 7110602 | 7110603 | 7110604 |
|---|---|---|---|---|---|---|---|
| Extruded alumina 20 grit | 55.68 | 55.68 | 55.68 | 55.68 | 55.68 | 55.68 | 55.68 |
| Durez 29722 | 18.37 | 18.37 | 18.37 | 18.37 | 18.37 | 18.37 | 18.37 |
| Saran | 0.00 | 0.00 | 0.00 | 0.00 | 0.00 | 0.00 | 0.00 |
| PKHP-200 | 0.97 | 0.97 | 0.97 | 0.97 | 0.97 | 0.97 | 0.97 |
| Pyrite | 10.10 | 10.10 | 10.10 | 10.10 | 10.10 | 10.10 | 10.10 |
| Potassium sulfate | 4.19 | 4.19 | 4.19 | 4.19 | 4.19 | 4.19 | 4.19 |
| Lime | 2.52 | 2.52 | 2.52 | 2.52 | 2.52 | 2.52 | 2.52 |
| SiC-800 | 0.00 | 0.00 | 0.00 | 0.00 | 0.00 | 0.00 | 0.00 |
| Fused brown aluminum oxide 220 grit | 2.17 | 2.17 | 2.17 | 0.00 | 0.00 | 0.00 | 0.00 |
| Mineral Wool | 3.00 | 0.00 | 0.00 | 2.17 | 2.17 | 2.17 | 2.17 |
| 4 mm OCF-497 | 3.00 | 0.00 | 0.00 | 6.00 | 3.00 | 3.00 | 0.00 |
| 4 mm Coated Strand | 0.00 | 3.00 | 0.00 | 0.00 | 0.00 | 0.00 | 0.00 |

TABLE 2A-continued

| Component | 07100201 | 07100202 | 07100203 | 7110601 | 7110602 | 7110603 | 7110604 |
|---|---|---|---|---|---|---|---|
| 12 mm Coated Strand | 0.00 | 0.00 | 3.00 | 0.00 | 3.00 | 0.00 | 6.00 |
| 25 mm Coated Strand | 0.00 | 0.00 | 0.00 | 0.00 | 0.00 | 3.00 | 0.00 |

Figure 9:
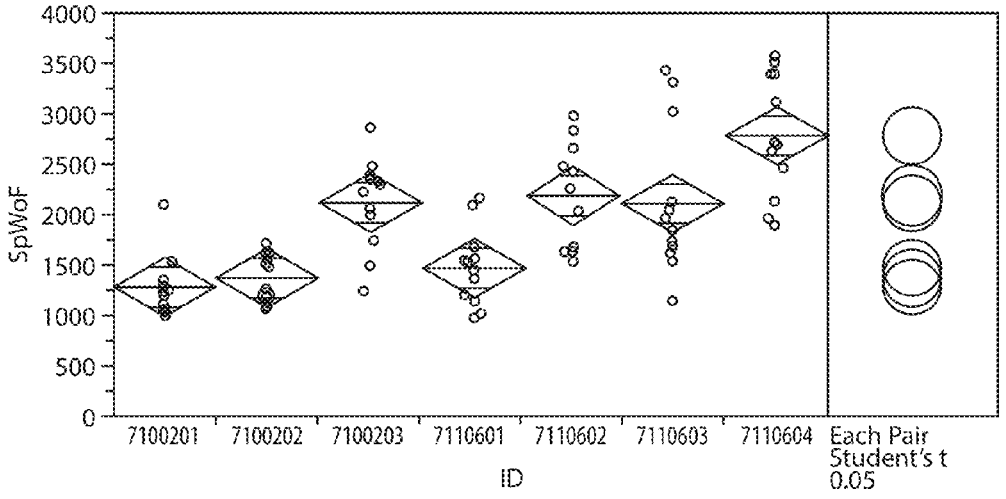

As shown in FIG. 9, the Wof of the 12 mm thermoplastic coated 3 vol % samples is significantly greater (about 60%) than that of the conventional shorter thermoset coated samples. The 4 mm thermoplastic coated samples also performed better than the conventional shorter thermoset coated samples. The Wof of the 12 mm thermoplastic coated 6 vol % samples was up to about 90% greater than that of the conventional 4 mm thermoset coated samples. Overall, the embodiments of the samples outperformed the conventional samples by about 6% to about 90%. All samples had similar strengths.

Example 3

As described in Table 2B, additional samples were prepared to compare wheels with conventional reinforcement webs (samples 711605) to wheels with coated chopped strands or CCS (samples 711606) in a mat or layer. The samples were otherwise identical to each other, and prepared in the same manner as Example 2. During fabrication, one half of the mix was transferred to the mold, spread evenly and the web or the 2" coated yarn was placed/deposited as a mat. The remaining mix was transferred on top of the reinforcement and pressed as described for Example 1.

TABLE 2B

| Component | 7110605 | 7110606 |
|---|---|---|
| Extruded and sintered aluminum oxide 20 grit (vol %) | 55.68 | 55.68 |
| Durez 29722 (vol %) | 18.37 | 18.37 |
| Saran (vol %) | 0.00 | 0.00 |
| PKHP-200 (vol %) | 0.97 | 0.97 |
| Pyrite (vol %) | 10.10 | 10.10 |
| Potassium sulfate (vol %) | 4.19 | 4.19 |
| Lime (vol %) | 2.52 | 2.52 |
| SiC-800 (vol %) | 0.00 | 0.00 |
| Fused brown aluminum oxide 220 grit (vol %) | 0.00 | 0.00 |
| Mineral wool -PMF (vol %) | 2.17 | 2.17 |
| 4 mm OCF-497 (vol %) | 6.00 | 6.00 |
| IPAC Style 24 glass web (g/wheel)) | 20.4 | 0 |
| 50 mm CCS(grams/wheel) | 0.00 | 20.4 |

Figure 8:
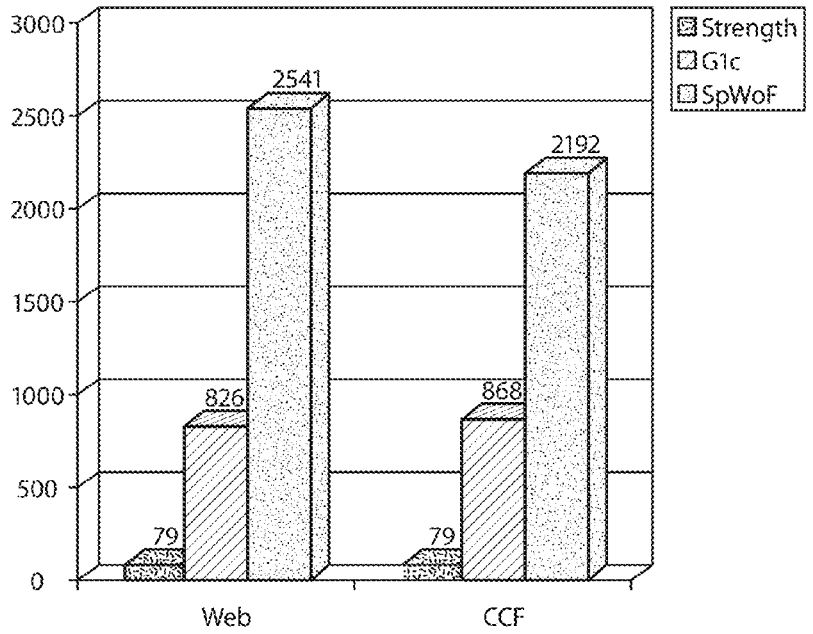
FIGS. 8 and 9 are plots of the performances of conventional abrasive articles and embodiments of articles.

The test results for the samples of Table 2B are represented in FIG. 8. The coated chopped fiber (CCF) samples had a Wof of about 2192, while the conventional web samples had a Wof of about 2541. Thus, the Wof of the CCF samples were within about 14% of that of the conventional web samples. In addition, the CCF samples had a G1C of about 868, while the conventional web samples had a G1C of about 826. Thus, the G1C of the CCF samples were about 5% better than that of the conventional web samples. Using a three-point bend test, both sets of samples had a strength of about 79. These results indicate that the mechanical properties for abrasive articles with discontinuous short fibers having a thermoplastic secondary coating are comparable to those of abrasive articles with continuous fiber glass strand woven webs at the same overall glass content.

Embodiments of CSF can be an alternative to or supplement for continuous web reinforcements. CSF requires lower labor and resource intensive process than webs. CSF may use a fiber distribution process that consistently delivers the fibers to the mold consistently in the same way. To date, no abrasive wheels have utilized thermoplastic coated fibers having at least an initial length in excess of 0.25 inches and high LOI. An embodiment of this disclosure is to use a continuous strand yarn or roving that is chopped "in situ" (i.e., real time) into discrete or discontinuous fibers during manufacturing of abrasive articles. The fibers may have at least an initial length in excess of 0.25 inches, and may be chopped and placed directly into the mold cavities in real time as the abrasive articles are being fabricated.

This process eliminates the two waste streams mentioned herein to provide a zero fiber waste process. In addition, this process requires a smaller storage footprint in the manufacturing facility, as well as a highly flexible method to manipulate and prescribe wheel properties and performance. Examples of the flexibility in manipulating the wheel properties and performance include changing the chopped length of the CSF, the bundle size, the fiber type, and the fiber amount. Compared to conventional wheels with phenolic-coated web reinforcements, in situ CSF provide comparable strength, fracture toughness, and specific work of fracture.

For example, thermoplastic coated or thermoset coated yarns may be commercially desirable. However, thermoset yarns are inherently stiffer, and hence would result in high loft which would make it difficult to achieve the correct mold fill. Additionally, the stiffer strands give rise to spring-back, thus introducing undesired porosity into the wheel. In addition, to obtain good wet/out and bonding of the thermoset coating to the matrix resin (or bond), the degree of cure may be precisely controlled, which can be difficult, as thermosets age (cure) with time and temperature. In contrast, properly selected thermoplastics reduce these problems.

Example 4

Additional samples were prepared with a standard wheel process. Two zone composite wheels comprising equal volumes of a grinding and fine back formulation were prepared by first transferring the fine back formulation into a 125 mm diameter cavity with a 22 mm center arbor containing a glass web. A second glass web was added to the mold cavity to which was then transferred the grinding zone formulation. One ½ diameter web was placed on top followed by cold pressing with sufficient pressure to achieve 7 mm thick flat wheels. The wheels were removed from the mold, placed between Type 27 curing plates, stacked onto curing post and compressed with sufficient pressure to obtain the desired (Type 27) shape. The stacked wheels under sufficient pressure were then cured according to the schedule describe in Table 3. Preparation of the mixes according to Tables 4 and 5 included first wetting the abrasives with liquid resin followed by addition of bond and sufficient mixing to obtain a uniform mix consistency. The compositions were allowed to age for at least 2 hours before molding.

TABLE 3

| Cure profile | | | |
|---|---|---|---|
| Step | Cure Profile | Time (hr) | Temperature (° C.) |
| 1 | Ramp | 5 | to 194 |
| 2 | Soak | 3.5 | at 194 |
| 3 | Ramp | 3.5 | to 60 |

TABLE 4

| Standard Grinding zone wheel formulation | | | |
|---|---|---|---|
| | Component | Specific Gravity | vol % |
| Abrasive | Zirconum alumina 20 grit | 4.6 | 0.160 |
| | Zirconum alumina 24 grit | 4.6 | 0.160 |
| | Targa 36 grit | 3.9 | 0.103 |
| Wetting resin | Durez 94906 | 1.2 | 0.100 |
| Bond | Durez 29722 | 1.28 | 0.152 |
| | Iron pyrite | 4.75 | 0.035 |
| | Potassium sulfate | 2.66 | 0.035 |
| | calcium oxide | 3.35 | 0.013 |
| Porosity | | 0 | 0.244 |

The BMC compound was prepared by charging a Brabender with resins, kaolin and hexamethelentetramine (see, e.g, Table 4) and mixed until homogeneous (about 5 to 10 minutes). Fillers (Kaolin and Nipol) were added and mixed until well dispersed (about 5 minutes). Fiber reinforcement is added and mixed for no more than another 5 minutes to keep the temperature from exceeding 90° C. The BMC is removed and cut to the desired weights required to make the appropriate prepreg dimensions. Prepregs are formed by compression molding pre-warmed (70° C. for 10 to 15 minutes) charges at 70° C. using a Carver Press and mold of desired dimensions. Once pressed, the prepregs are cooled to room temperature, removed from the mold and stored at (0-10° C.) until needed. The prepregs are warmed to room temperature immediately before molding with the grinding zone mix to make wheels as described below. In Table 4, the zirconium is aluminum-zirconium oxide, and the Targa is extruded and sintered aluminum oxide.

BMC top hat "TH" wheel making process: pre-warmed (to 60-80° C.) BMC prepregs having the desired dimensions were place directly into the mold cavity. Grinding zone mix was deposited on top of the warm BMC prepreg and pressed with sufficient pressure to obtain a final part thickness of 7 mm. The green wheels were then treated in the same way as described above to shape and cure the wheels.

TABLE 5

| Components | | | | | |
|---|---|---|---|---|---|
| | Component | Specific Gravity | BMC8-1 (Volume) | BMC8-2 (Volume) | BMC8-3 (Volume) |
| Resins | Durez 75108 | 1.18 | 9.06 | 9.06 | 9.06 |
| | Momentive 8505 | 1.17 | 34.92 | 34.92 | 34.92 |
| Curing agent | hexamethylene-tetramine | 1.33 | 4.02 | 4.02 | 4.02 |
| Fillers | Kaolin | 2.6 | 27 | 12 | 2 |
| | Nipol 1411 | 1.0 | 0 | 15 | 25 |
| Reinforce-ment | HF 6000 2" | 2.38 | 25 | 25 | 25 |

HF is commercially available from Lite Fiber LLC, and Nipol is commercially available from Zeon.

These Type 27 samples of conventional abrasive articles and embodiments of abrasive articles were constructed and safety tested by the European Union standard EN 12413. The tests included side load testing and burst speed testing after side load testing.

Figure 12:
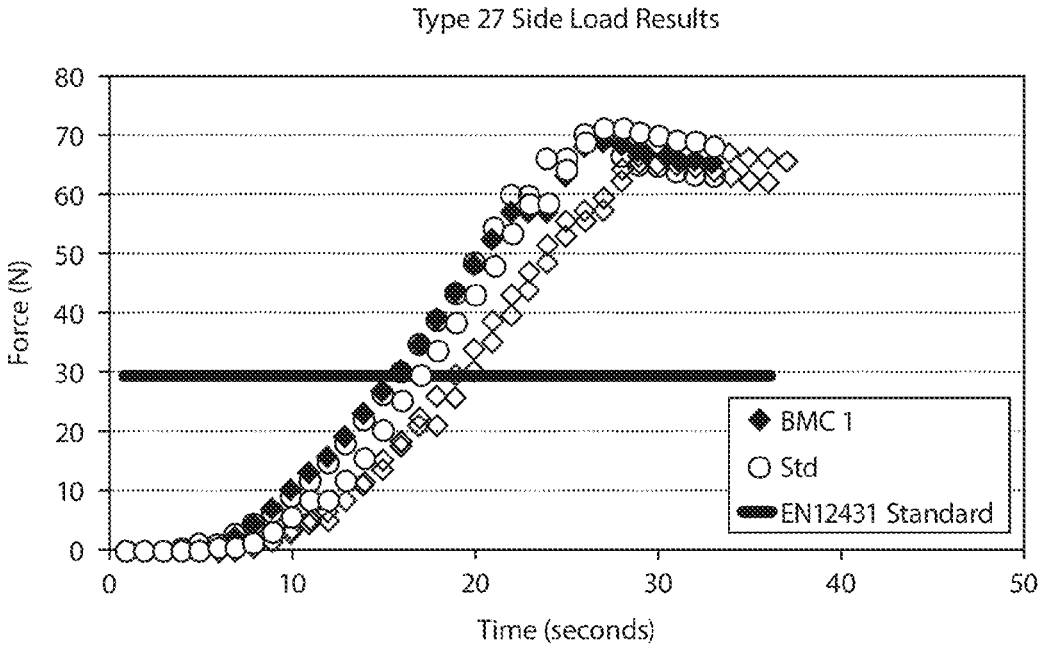
FIG. 12 is a plot of side load testing for conventional abrasive articles and embodiments of abrasive articles.

FIG. 12 depicts the results of the test. The EN standard is illustrated as the horizontal line. As shown by the test data points, the wheel embodiments performed as well or better than the conventional wheels. In addition, the BMC average burst speed was 20310, and the average burst speed of the conventional wheels was 20258 rpm.

Figure 13A:
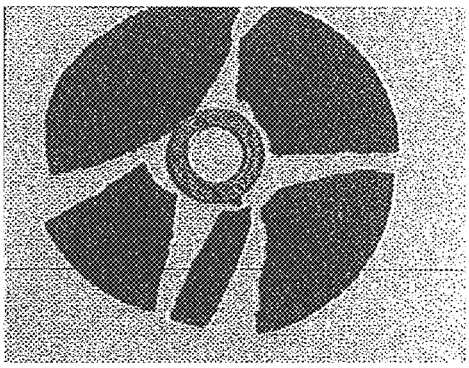
FIGS. 13A and 13B are photographs of an embodiment of an abrasive wheel and a conventional wheel, respectively, after side load testing.
Figure 13B:
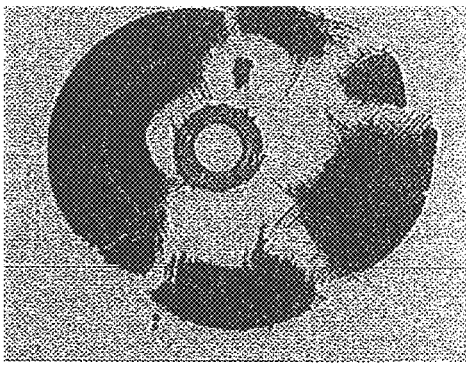

FIGS. 13A and 13B depict an embodiment wheel and a conventional wheel, respectively, after side load testing. The fragmentation pattern of the BMC wheel shows no delamination, whereas the conventional wheel shows more fragmentation.

Example 5

Figure 14A:
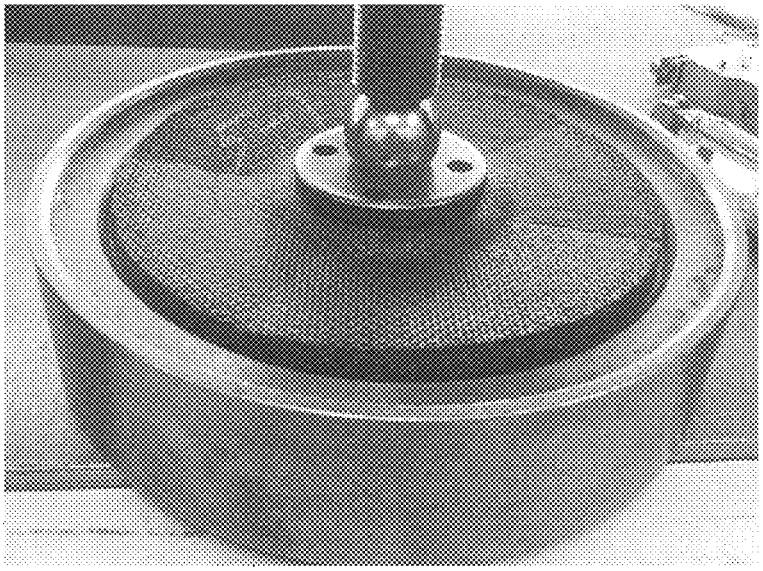
FIG. 14A is a photograph of an abrasive wheel mounted in ring-on-ring test equipment.

The samples were also tested for a ring-on-ring or compression test. As shown in FIG. 14A, the test comprised placing a sample wheel on a hollow cylinder having a central bore. The bore is slightly smaller in diameter than the sample wheel, such that only the circular perimeter of the sample wheel is supported by the cylinder. A steel hub is placed in the center of the sample wheel, and a steel ball is placed on the hub. A downward vertical force is then exerted on the steel ball by steel rod.

Figure 14B:
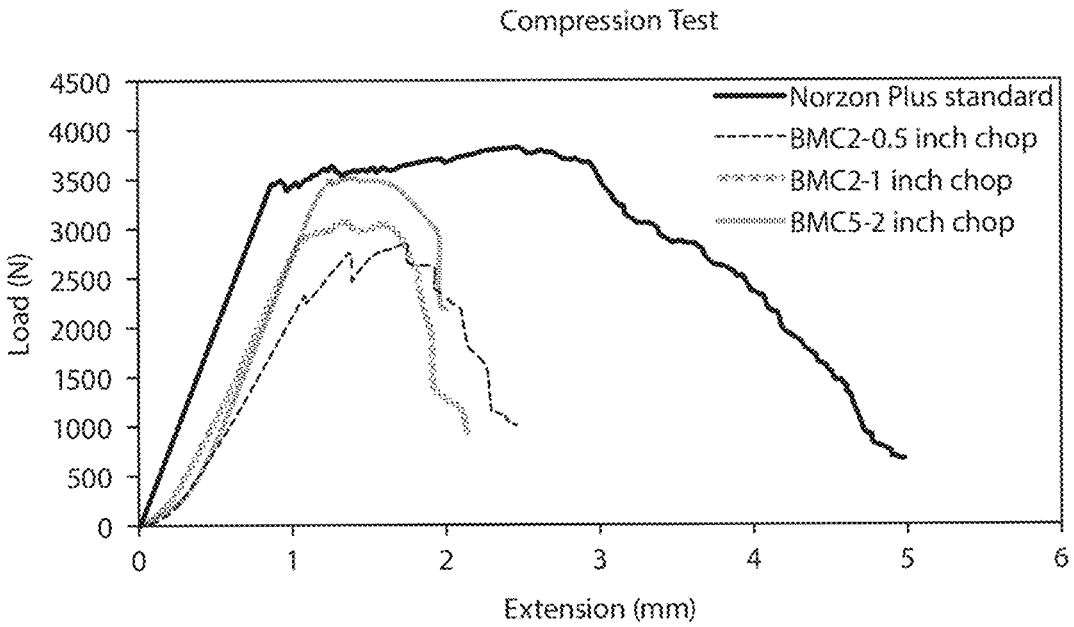
FIG. 14B is a plot of compression testing for conventional abrasive articles and embodiments of abrasive articles.

FIG. 14B depicts the results of the test. As shown by the test data, the wheel embodiments performed similarly to the conventional wheels in terms of load handling, but had less extension or flexibility. In particular, strength and work of fracture was increased by increasing the length of the CSF.

Example 6

Two zone composite wheels comprising equal volumes of a grinding and fine back formulation were prepared by first transferring the fine back formulation into a 125 mm diameter cavity with a 22 mm center arbor containing a glass web. A second glass web was added to the mold cavity to which was then transferred the grinding zone formulation followed by cold pressing with sufficient pressure to achieve 3.5 mm thick flat wheels. The wheels were removed from the mold, placed between type 27 curing plates, stacked onto a curing post and compressed with sufficient pressure to obtain the desired (Type 27) shape. The stacked wheels having sufficient pressure were then cured according to the schedule described in Table 6. Preparation of the mixes was conducted according to Tables 7 and 8. The process included first wetting the abrasives with liquid resin followed by addition of bond and sufficient mixing to obtain a uniform mix consistency. The compositions were allowed to age for at least 2 hours before molding. In these tables, PAF is potassium aluminum fluoride, Panex fiber is sold by Zoltec, alumina is fused aluminum oxide, and alumina-zirconia is fused aluminum-zirconium oxide.

TABLE 6

| Process | | | |
|---|---|---|---|
| Cure profile | Time | | Temperature |
| Ramp | 1 hr | To | 60° C. |
| Soak | 1 hr | @ | 60° C. |
| Ramp | 16 hr 24 min | To | 125° C. |
| Soak | 0 hr 01 min | @ | 125° C. |

TABLE 6-continued

| Process | | | |
|---|---|---|---|
| Cure profile | Time | | Temperature |
| Ramp | 7 hr 30 min | To | 165° C. |
| Soak | 5 hr | @ | 165° C. |

TABLE 7

| Grinding zone formulations | | | | | |
|---|---|---|---|---|---|
| | | | Vol % | | |
| | Component | Density | GZ01 | GZ02 | GZ03 |
| Abrasive | Alumina 36 grit | 3.95 | 0.043 | 0.043 | 0.043 |
| | Alumina-zirconia abrasive 36 grit | 4.6 | 0.085 | 0.085 | 0.085 |
| | Seeded gel abrasive 36 grit | 3.98 | 0.043 | 0.043 | 0.043 |
| | Alumina 46 grit | 3.95 | 0.043 | 0.043 | 0.043 |
| | Alumina-zirconia abrasive 46 grit | 4.6 | 0.085 | 0.085 | 0.085 |
| | Seeded gel abrasive 46 grit | 3.98 | 0.043 | 0.043 | 0.043 |
| Wetting resin | Durez 94906 | 1.2 | 0.127 | 0.122 | 0.122 |
| Bond | Resin 29346 | 1.28 | 0.225 | 0.216 | 0.216 |
| | cabosil | 2.2 | 0.008 | 0.008 | 0.008 |
| | Cryolite | 2.85 | 0.030 | 0.020 | 0.020 |
| | PAF | 2.85 | 0.030 | 0.020 | 0.020 |
| | Duomod 5045 | 1.08 | | 0.034 | |
| | Panex fiber powder | 1.82 | | | 0.034 |

TABLE 8

| Fine back formulations | | | | | |
|---|---|---|---|---|---|
| | | | Vol % | | |
| | Component | Density | FB01 | FB02 | FB03 |
| Abrasive | Brown fused Alumina 80 grit | 3.95 | 0.26 | 0.26 | 0.26 |
| | Brown fused Alumina 150 grit | 3.95 | 0.18 | 0.18 | 0.18 |
| Wetting resin | Durez 94906 | 1.2 | 0.10 | 0.10 | 0.09 |
| Bond | Durez 29717 | 1.28 | 0.00 | 0.26 | 0.00 |
| | Durez 29346 | 1.28 | 0.26 | 0.00 | 0.23 |
| | Duomod 5045 | 1.08 | 0.00 | 0.00 | 0.03 |

Figure 15:
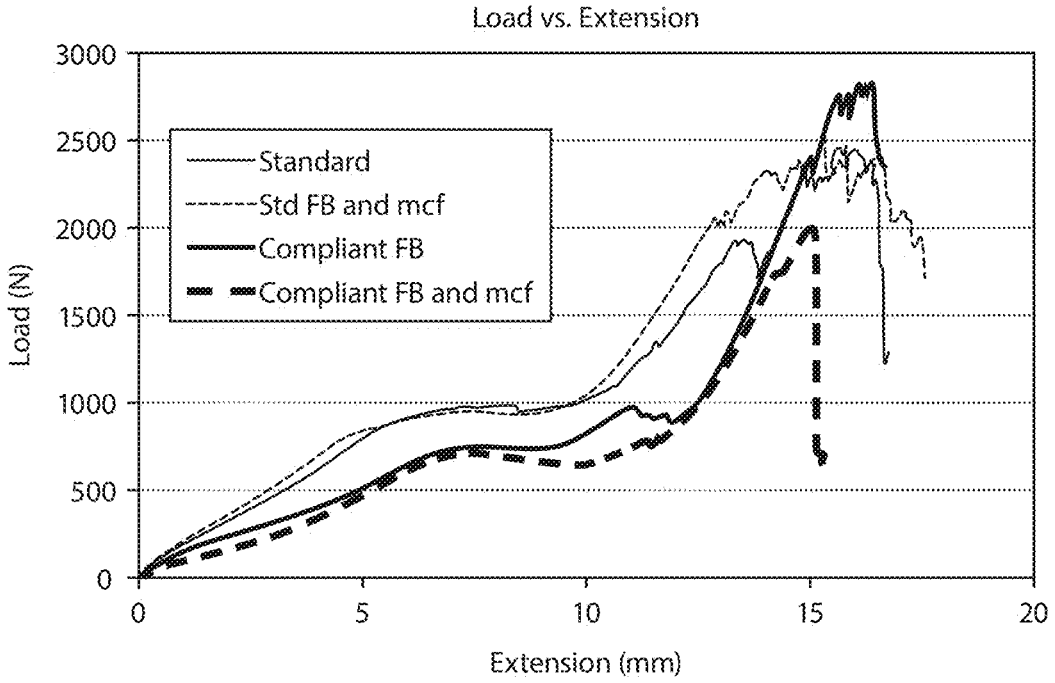
FIG. 15 is a plot of load versus extension for conventional abrasive articles and embodiments of abrasive articles.

FIG. 15 includes a plot of load versus extension for conventional abrasive articles and embodiments of abrasive articles as described above. The "Standard" wheel and "Std FB and mcf" wheel were identical except that the latter included a conventional rigid fine back layer and milled carbon fibers in the grinding zone.

The wheel described as "Compliant FB" was identical with a conventional grinding zone, except that it included elastomeric particles in the fine back layer.

Similarly, the wheel described as "Compliant FB and mcf" was identical to the others except that it included elastomeric particles in the fine back layer and milled carbon fibers in the grinding layer.

The fine back is traditionally formulated to be higher in strength/stiffness and lower in cost than the grinding zone. However, the rubber particle-modified fine back examples show a reduction in slope over the entire usable range of the wheels. Accordingly, compliance can be added to the fine back layer using the discrete pre-cross linked rubber particles.

For example, as shown in FIG. 15, the conventional wheels require about 800 N to bend or extend about 5 mm. That is a slope of about 6.25 mm/kN (i.e., 5 mm/0.8 kN). Conversely, the embodiments of the wheels require about 400 N to bend or extend about 5 mm. That is a slope of about 12.5 mm/kN (i.e., 5 mm/0.4 kN). In this example, the embodiment wheel has about twice as much compliance as the standard wheel.

Example 7

Figure 16:
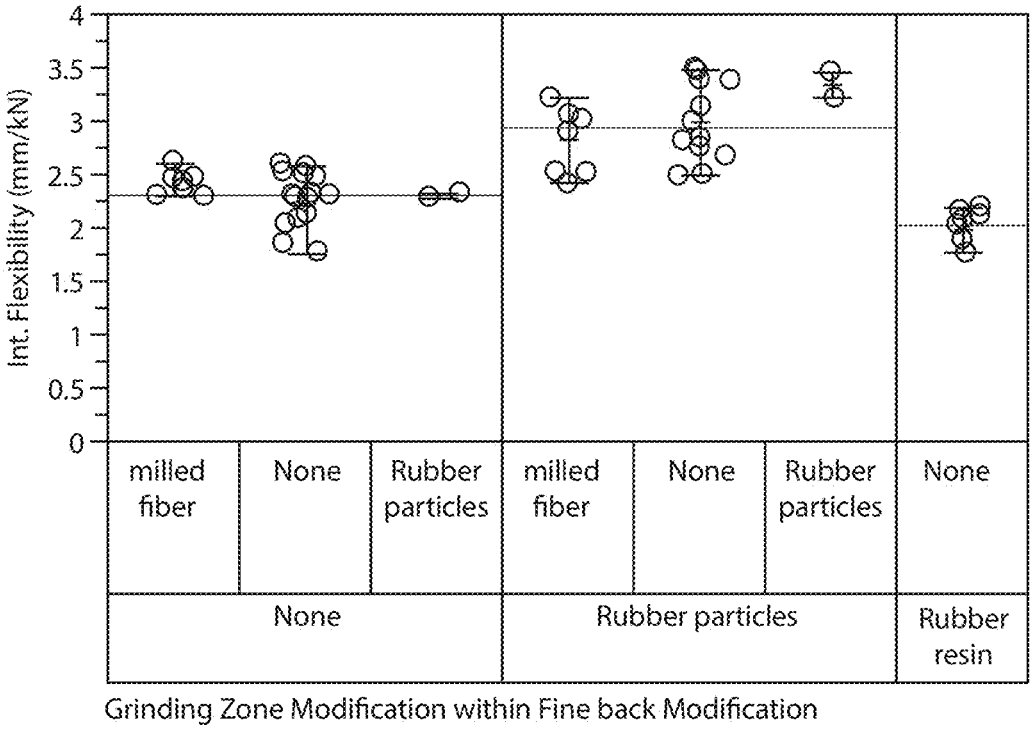
FIG. 16 demonstrates the initial flexibility of conventional abrasive articles and embodiments of abrasive articles.

FIG. 16 demonstrates the initial flexibility (i.e., as manufactured, without pre-stressing) of 7 sample wheels. The set of three samples on the left side of FIG. 16 have a standard fine back layer as described above, but have different types of grinding zones (in order, from left to right): milled fibers, a conventional grinding zone, and rubber particles. The one sample of the far right included a conventional grinding zone and a conventional rubber resin in the fine back layer. The rubber resin was a rubber-modified novolac resin, commercially available as 29717 from Durez, or 8686 from Momentive. The set of three samples in the middle were constructed as embodiments described herein. They were identical to the other set of three samples, except that they included rubber particles in their fine back layers.

Figure 17:
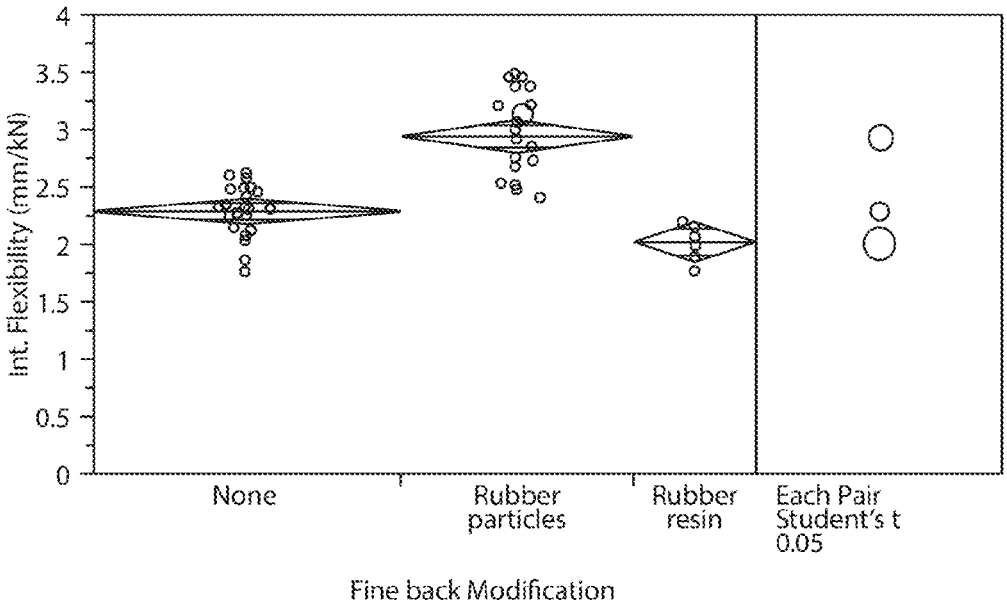
FIG. 17 includes one way analysis of variance for the data of FIG. 16.

FIG. 17 and Table 9 include one way analysis of variance or ANOVA plots for FIG. 16. The term "Std Error" includes a pooled estimate of error variance.

TABLE 9

| Data for FIGS. 16 and 17 | | | | | |
|---|---|---|---|---|---|
| Level | Number | Mean | Std Error | Lower 95% | Upper 95% |
| None | 30 | 2.30733 | 0.04627 | 2.2149 | 2.3998 |
| Rubber particles | 23 | 2.95696 | 0.05284 | 2.8513 | 3.0626 |
| Rubber resin | 12 | 2.03833 | 0.07315 | 1.8921 | 2.1846 |

The mean for the first set of three samples was about 2.3 mm/kN. The mean for the embodiments of second set of three samples was about 3.0 mm/kN. That is an improvement of about 30% in initial compliance. Compared to the far right sample (mean of about 2.0), the embodiments disclosed herein offer an improvement of about 50% in initial compliance.

This data demonstrates that the addition of rubber particles to the unmodified novolac fine back formulation provides statistically better compliance than using a rubber-modified novolac resin. Moreover, the addition of rubber particles to the fine back layer provides more compliance to the wheel than if the rubber particles were added the grinding zone.

Example 8

The same seven samples described above also were tested for post flexibility. Post flexibility is the flexibility of fresh samples after they are pre-stressed as described herein. The samples and order depicted in and described above for FIG. 17 are identical to those in FIG. 18, except that each sample was pre-stressed.

Figure 19:
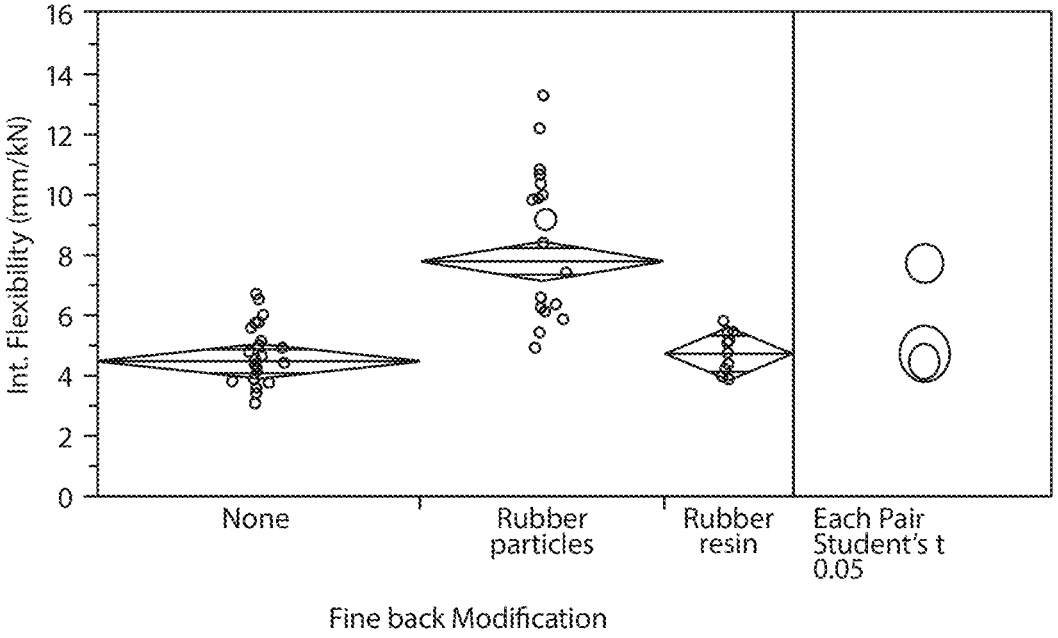
FIG. 19 includes one way analysis of variance for the data of FIG. 19.

FIG. 19 and Table 10 include one way analysis of variance or ANOVA plots for FIG. 4. The term "Std Error" includes a pooled estimate of error variance.

TABLE 10

Figure 18:
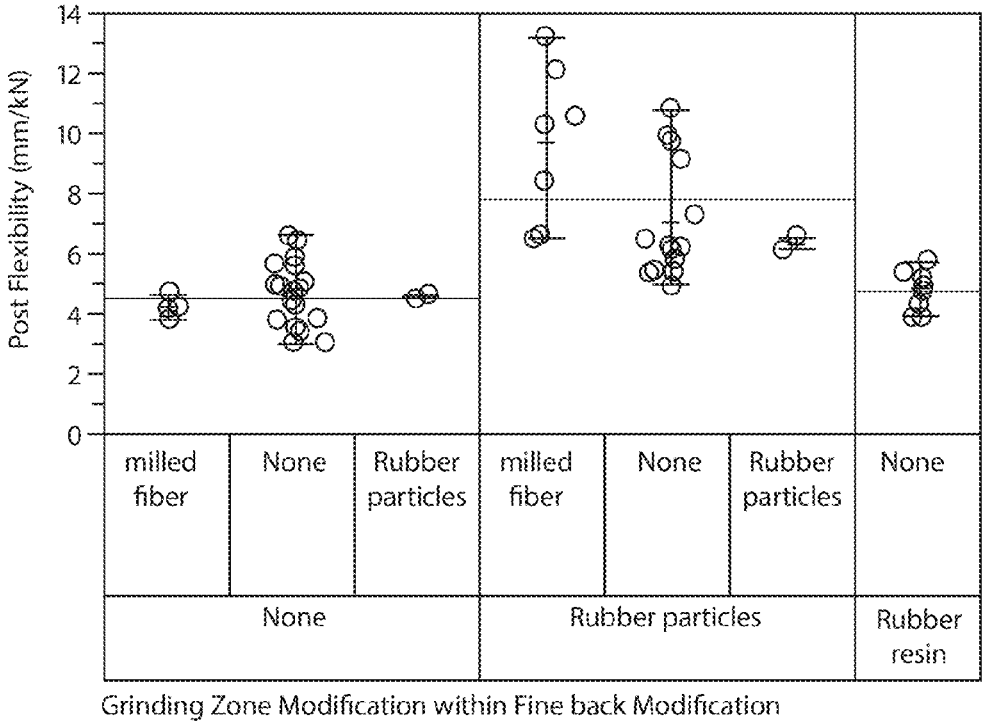
FIG. 18 demonstrates the post flexibility of conventional abrasive articles and embodiments of abrasive articles.

| Data for FIGS. 18 and 19 | | | | | |
|---|---|---|---|---|---|
| Level | Number | Mean | Std Error | Lower 95% | Upper 95% |
| None | 30 | 4.53000 | 0.28820 | 3.9539 | 5.1061 |
| Rubber particles | 23 | 7.81348 | 0.32914 | 7.1555 | 8.4714 |
| Rubber resin | 12 | 4.76750 | 0.45568 | 3.8566 | 5.6784 |

The mean for the first set of three samples was about 4.5 mm/kN. The mean for the embodiments of the second set of three samples was about 7.8 mm/kN. That is an improvement of about 73% in pre-stressed compliance. Compared to the far right sample (mean of about 4.8), the embodiments disclosed herein offer an improvement of about 63% in pre-stressed compliance.

Again, this data demonstrates that the addition of rubber particles to the unmodified novolac fine back formulation provides statistically better compliance than using a rubber-modified novolac resin. Using commercial rubber-modified phenolic resins in which rubbers are either reacted or blended into the resin during the 'cooking' process does not result in higher wheel flexibility. Moreover, the addition of rubber particles to the fine back layer provides more compliance to the wheel than if the rubber particles were added the grinding zone. The change in flexibility calculated from initial and post bending was on the order of twice as high as the traditional approach.

The embodiments of a flexible wheel disclosed herein enable the elimination of the mechanical pre-stress step. Such "self-complying" flexible wheels also permit substitution or augmentation of the mechanical pre-stressing step with a combination of composite design and formulation change.

The flexibility of the wheel can be influenced by incorporating an elastomer into the fine back. Embodiments disclosed herein add compliance to the fine back by using elastomer particles. The particles may include a defined particle size distribution. In some versions, the particles may be blended into the fine back formulation and subsequently molded onto the grinding zone of the wheel.

Embodiments of the elastomer used in the fine back may include pre-cross linked particles. Versions of the particles can have an average particle size in a range of about 1 micron to about 50 microns. Examples of the resin may include about 10 vol % to about 20 vol % of the particles.

Other embodiments may comprise a microfiber-infused grinding zone and a rubber-infused fine back layer that are molded together in about a 2:1 volume ratio. The attractiveness and practicality of this approach as opposed to conventional pre-stressed flexible wheels is that the operator controls the compliance by the force applied to the wheels while in use. The embodiments disclosed herein essentially provide a single product for all types of operators and grinding.

Embodiments of the microfibers in the grinding zone can be mineral fibers, carbon-based fibers or combinations thereof. Versions of the microfibers may be derived from mechanically milling of longer fibers. Embodiments of the microfibers can have an aspect ratio (l/d) of about 10 to about 100. Examples of the resin content may comprise about 5 vol % to about 10 vol % of the microfibers. In other embodiments, the microfibers can be suitably sized with a chemistry (e.g., a coating) to enable only weak bonding and preferably self-healing characteristics within the abrasive matrix.

Either or both of the microfibers and the elastomer particles may be incorporated into their respective formulations by a dry blending process.

Using commercial rubber-modified phenolic resins in which rubbers are either reacted or blended into the resin during the formation process does not result in higher wheel flexibility.

Example 9

Figure 20:
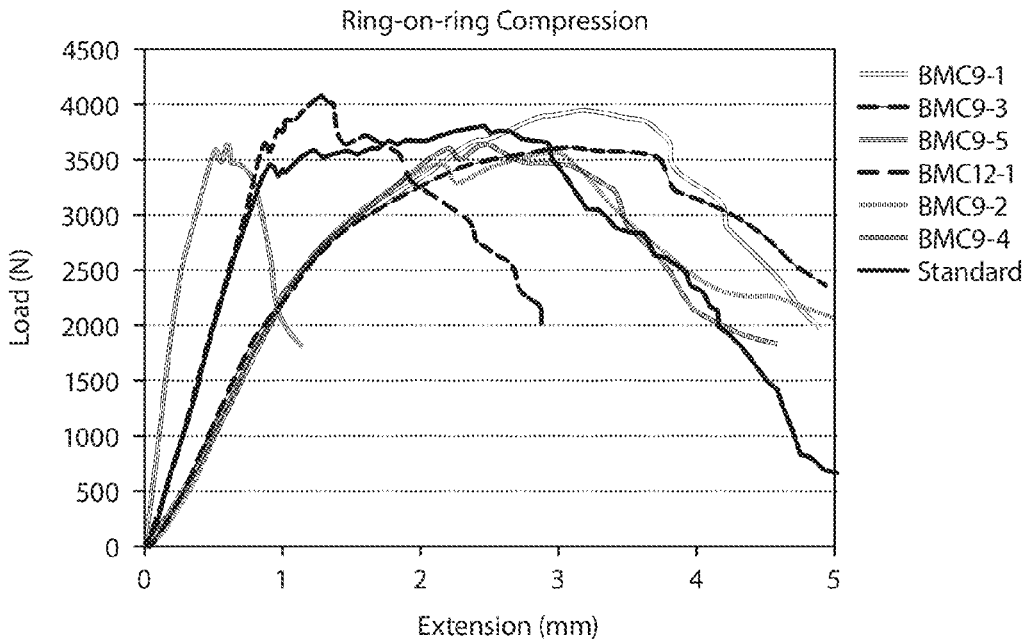
FIGS. 20 and 21 are plots of compression testing for conventional abrasive articles and embodiments of abrasive articles.

FIG. 20 summarizes the failure mechanics of abrasive wheels that were strained under compression forces until failure for various embodiments of BMC compositions and contrasted against a conventional fiber glass web-reinforced wheel. The BMC formulations summarized in Tables 11A and 11B include a compliant resin formulation containing various chopped fiber lengths and fiber bundle diameters of polyurethane (PUD) coated strand (HF-2000 and HF-6000). A traditional PUD coated ⅛" long chopped strand (OC 74 HAN) used to reinforce a compliant resin and a 2" long HF-6000 used to reinforced rigid resin matrix are included to contrast the benefits of this technology.

TABLE 11A

| Component | Specific Gravity (g/cc) | BMC 9-1 (Vol %) | BMC 9-2 (Vol %) | BMC 9-3 (Vol %) | BMC 9-4 (Vol %) | BMC 9-5 (Vol %) | BMC12-1 (Vol %) | BMC 7-1 (Vol %) | BMC7-2 (Vol %) |
|---|---|---|---|---|---|---|---|---|---|
| Durez 75108 | 1.18 | 10 | 10 | 10 | 10 | 10 | 10 | 9.6 | 9.6 |
| Hexamethylene tetramine | 1.33 | 1.8 | 1.8 | 1.8 | 1.8 | 1.8 | 1.8 | 1.7 | 1.7 |
| Momentive SD-1713 | 1.17 | 38.2 | 38.2 | 38.2 | 38.2 | 38.2 | 38.2 | 36.7 | 36.7 |
| Kaolin | 2.6 | 10 | 10 | 10 | 10 | 25 | 10 | 12 | 2 |
| Nipol 1411 | 1.0 | 15 | 15 | 15 | 15 | 0 | 15 | 15 | 15 |
| HF 6000 2" | 2.38 | 25 | | | | 25 | | | |
| HF 2000 2" | 2.38 | | 25 | | | | | 25 | 25 |
| HF 6000 1" | 2.38 | | | 25 | | | | | |
| HF 2000 1" | 2.38 | | | | 25 | | | | |
| OCF 174-⅛" | 2.6 | | | | | | 25 | | |

TABLE 11B

| Component | Specific Gravity (g/cc) | BMC7-1 (Vol %) | BMC7-2 (Vol %) |
|---|---|---|---|
| Resin 5-2 | 1.18 | 48 | 48 |
| Kaolin | 2.6 | 12 | 2 |
| Nipol 1411 | 1.0 | 15 | 25 |
| HF 6000 2" | 2.38 | 25 | 25 |

Burst speeds for some of these formulations are summarized in Table 12, and follow the relative trends observed in the compression testing. One interesting feature for the top hat TH (e.g., FIG. 10B) BMC construction is the residual intact core that remains on the spindle at burst speeds. By contrast, the conventional web reinforced wheel leaves no intact material on the spindle.

TABLE 12

Burst speeds

| Wheel construction | Formulation | Burst Speed (rpm) |
|---|---|---|
| Top hat | BMC9-1 | 21170 |
| Top hat | BMC9-2 | 22113 |
| Top hat | BMC9-3 | 21840 |
| Top hat | BMC9-4 | 21840 |
| Top hat | BMC9-5 | 19201 |
| Top hat | BMC12-1 | 21653 |
| Back-only | BMC9-1 | 18085 |
| Back-only | BMC9-2 | 17367 |
| Back-only | BMC9-3 | 17394 |
| Back-only | BMC9-4 | 17676 |
| Back-only | BMC9-5 | 17132 |

Both the rigid resin matrix reinforced with a long chopped fiber and the 'compliant' resin matrix reinforced with a conventional short CSF provide a relatively brittle failure mechanism as seen in the rapid stress-strain decay curve in FIG. 20. In contrast, a glass web reinforced wheel displays a more elastic and delayed failure mechanism due to the continuous nature of the reinforcement. In addition, the aforementioned wheels consistently show a steep stress-strain slope before the onset of failure indicating the rigidity of the composite. On the other hand, the complaint matrix reinforced with the long chopped fiber provides a relatively shallow stress-strain response before reaching a maximum followed by delayed decay analogous to the glass web.

Another non-obvious aspect demonstrated in the plots of FIG. 20 is the effect of chop length and bundle size. The energy of failure (EOF) as determined by the integrated area under the curve is indistinguishable between 1 inch and 2 inch chopped fiber reinforced wheels, whereas a noticeable EOF is observed as the bundle size is increased.

Figure 21:
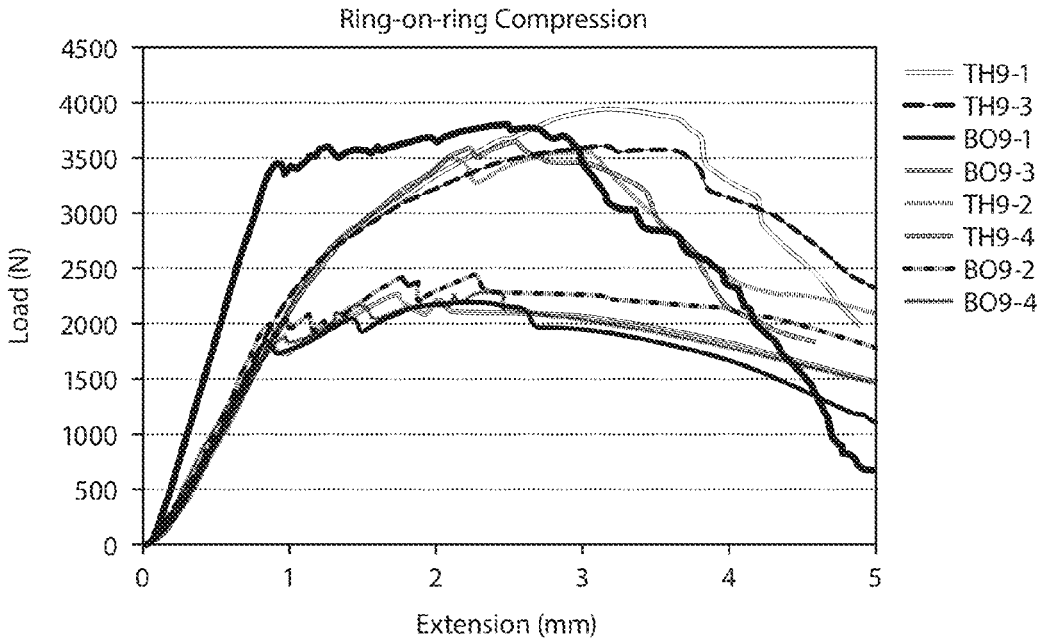

In some versions, a second component for achieving the desired fracture mechanics and EOF is the BMC's dimension within the wheel. For example, FIG. 21 shows that the ring-on-ring compression properties for various top hat (TH) wheel constructions can have significantly higher EOF values than comparable formulations made as back-only BO (e.g., FIG. 10A) wheel constructions.

Example 10

Grinding performance for BMC reinforced wheels was assessed using the following procedure. Standard abrasive mixing procedures were used for both grinding zone (GZ) and fineback (FB) layer. See Tables 13 and 14.

TABLE 13

Grinding zone mix formulations

| Material Name | Specific gravity (g/cc) | Experiment No. GZ01 Vol % in wheel | Experiment No. GZ02 Vol % in wheel |
|---|---|---|---|
| Seeded Gel -20 grit | 3.95 | 0 | 38.0 |
| Brown-fused Alumina-20, 24, 36 grits | 3.95 | 42 | |
| Nepheline Syenite-30 grit | 2.61 | 0 | 12.0 |
| Liquid resole | 1.2 | 9.0 | 10.0 |
| Durez 29722 | 1.28 | 16.4 | 17.7 |
| Iron Pyrite | 4.75 | 0.00 | 0.00 |
| Potassium Sulfate | 2.66 | 3.5 | 0.00 |
| Lime | 3.35 | 3.5 | 0.00 |
| Potassium aluminum fluoride | 2.85 | 1.3 | 10.4 |
| Total abrasive | | 42 | 50 |
| Bond | | 34 | 38 |
| POROSITY | | 24 | 12 |

TABLE 14

Fine Back mix formulation

| Material Name | Specific gravity (g/cc) | Experiment No. FB01 Vol % in wheel |
|---|---|---|
| Brown-fused Alumina-46 grit | 3.95 | 30 |
| Nepheline Syenite-30 | 2.61 | 15 |
| Liquid resole | 1.2 | 10.4 |
| Durez 29722 | 1.28 | 18.5 |
| Iron Pyrite | 4.75 | 3.4 |
| Potassium aluminum fluoride | 2.85 | 2.7 |
| Total abrasive (vol %) | | 45 |
| Bond (vol %) | | 35 |
| POROSITY (vol %) | | 20 |

Wheel preparation procedure for a 125 mm by 7 mm standard wheel construction (vAVAV). This included sequentially layering IPAC style 184 (122 mm) glass web, FB01 (50% of final wheel volume), IPAC style 3160 (118 mm) glass web, GZ01 (50 vol % of final wheel thickness), and IPAC Style 77 (90 mm) glass web. The wheels were compressed with pressure to a desired thickness, stacked between Type 27 steel plates, compressed with static load until desired shape was achieved and then cured using a stepped ramp to 195° C. over 18 hours, with a subsequent 6 hour soak at 195° C.

The wheel preparation procedure for a 125 mm by 7 mm BMC Top Hat wheel construction included the following. A BMC prepreg having the dimensions of 118 mm by 3 mm, with a 23 mm center hole was transferred into the mold cavity followed by a second BMC prepreg having the dimensions of 80 mm by 3 mm, with a 23 mm center hole. The grinding zone mix was then added and compressed in the usual way. The wheels were compressed with pressure to a desired thickness, stacked between Type 27 steel plates, compressed with static load until desired shape was achieved and then cured using a stepped ramp to 195° C. over 18 hours, with a subsequent 6 hour soak at 195° C.

The BMC prepreg procedure included a mold of desired dimensions was charged with pre-warmed BMC and pressed/stamped in a Carver press. Manual Grinding results were on flat stock 1018 Carbon Steel work-piece using a Metabo 2100024159/W 11-125 grinder over six, five minute intervals.

For this evaluation two grinding zones (GZ) known to have significantly different performance levels were used in combination with the BC9-1 formulation in the TH construction and compared against the same GZ formulation but with standard 3-ply glass web construction. The results summarized in Table 15 show that the BMC-based wheels provide comparable or lower wheel wear rates (WWR), comparable or higher Metal Removal rates (MRR), and higher Q-ratios (MRR/WWR) than wheels having a standard construction without breaking.

TABLE 15

| Wheel Spec | Grind time (min) | Grinding Power (Hp) | Wheel Wear Rate (g/min) | Mat. Rem. Rate (g/min) | G-ratio | Specific Grinding Energy (hp-min/in3) |
|---|---|---|---|---|---|---|
| Std wheel construction GZ01 | 5 | 0.8 | 1.43 | 12.80 | 9.0 | 7.6 |
| | 5 | 0.8 | 0.52 | 8.20 | 15.8 | 12.0 |
| | 5 | 0.9 | 0.92 | 12.00 | 13.1 | 10.1 |
| | 5 | 0.8 | 1.09 | 12.60 | 11.5 | 7.8 |
| | 5 | 1.2 | 1.55 | 12.80 | 8.3 | 11.7 |
| | 5 | 0.7 | 0.44 | 10.80 | 24.5 | 8.1 |
| Average | | | 1.0 | 11.5 | 13.7 | 9.6 |
| BMC Top hat and GZ01 | 5 | 0.7 | 1.07 | 9.80 | 9.2 | 8.9 |
| | 5 | 0.7 | 0.54 | 8.60 | 15.9 | 11.1 |
| | 5 | 0.7 | 0.35 | 9.20 | 26.1 | 10.3 |
| | 5 | 0.7 | 0.33 | 8.20 | 25.2 | 10.5 |
| | 5 | 0.7 | 0.37 | 9.00 | 24.3 | 9.5 |
| | 5 | 0.6 | 0.25 | 6.00 | 24.2 | 11.8 |
| Average | | | 0.5 | 8.5 | 20.8 | 10.4 |
| Std wheel construction GZ02 | 5 | 0.6 | 0.36 | 16.20 | 45.0 | 4.8 |
| | 5 | 0.7 | 0.93 | 18.60 | 20.0 | 4.6 |
| | 5 | 0.7 | 0.64 | 20.40 | 31.8 | 4.5 |
| | 5 | 0.8 | 0.90 | 22.20 | 24.6 | 4.9 |
| | 5 | 0.6 | 0.32 | 19.00 | 59.0 | 4.3 |
| | 5 | 0.9 | 1.22 | 23.40 | 19.2 | 5.1 |
| Average | | | 0.7 | 20.0 | 33.3 | 4.7 |
| BMC Top hat and GZ02 | 5 | 0.6 | 0.31 | 19.60 | 63.2 | 4.3 |
| | 5 | 0.6 | 0.21 | 17.80 | 86.4 | 4.6 |
| | 5 | 0.7 | 0.22 | 18.00 | 81.8 | 5.3 |
| | 5 | 0.8 | 0.30 | 20.60 | 69.1 | 4.8 |
| | 5 | 0.7 | 0.18 | 19.00 | 106.7 | 5.1 |
| | 5 | 0.7 | 0.22 | 18.40 | 82.9 | 5.0 |
| Average | | | 0.2 | 18.9 | 81.7 | 4.8 |

Figure 22:
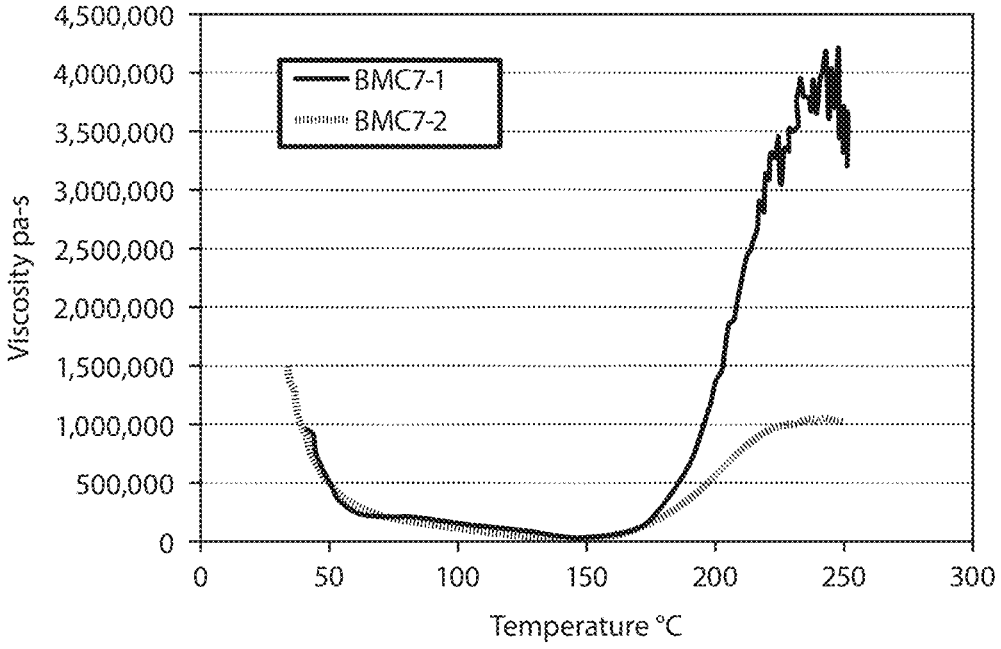
FIG. 22 is a plot of viscosity for embodiments of a component for abrasive articles.

FIG. 22 is a plot of viscosity performance for embodiments of a component of an abrasive article. The component may comprise a thermosetting phenolic material, for example. Samples BMC7-1 and BMC7-2 are summarized in Tables 11A and 11B.

FIG. 22 summarizes viscosity measurements of the BMC using a rotational rheometer on 2.5 mm diameter discs formed from the BMC and having an initial axial thickness of 3.5 mm. A TA Instruments ARES rotational rheometer was used with the following parameters:

Temperature Ramp Test Parameters:

Geometry: Parallel plate, 25 mm

Gap: 3.5-4 mm

Frequency: 6.283 rad/s

Temperature: 35° C.-250° C.

Ramp Rate: 5° C./min

Strain: 0.007% (auto-strain adjustment strain went from 0.001-0.03%)

Normal Force: 1000 g+/−100 g

Atmosphere: Nitrogen

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article, comprising:

an abrasive portion comprising an organic bond and abrasive particles; and a non-abrasive portion (NAP) coupled to the abrasive portion, the NAP comprising a resin matrix comprising molding compound (MC) and a plurality of discrete chopped strand fiber bundles dispersed throughout the resin matrix, and wherein the NAP is free of abrasive particles.

2. The abrasive article of claim 1, wherein the NAP extends from a peripheral center of the abrasive article and has a diameter of not less than 30% of a diameter of the abrasive portion.

3. The abrasive article of claim 1, wherein the chopped strand fiber bundles comprise fiberglass.

4. The abrasive article of claim 1, wherein the NAP comprises a core and a back layer.

5. The abrasive article of claim 4, wherein the core and the back layer comprise the MC.

6. The abrasive article of claim 4, wherein an outer diameter of the back layer is greater than an outer diameter of the core.

7. The abrasive article of claim 4, wherein a combined axial thickness of the core and the back layer is greater than an axial thickness of the abrasive portion.

8. The abrasive article of claim 4, wherein the back layer is contiguous with the core.

9. The abrasive article of claim 4, wherein a combined axial thickness of the back layer and the core is substantially equal to an axial thickness of the abrasive article.

10. The abrasive article of claim 1, wherein the NAP comprises at least one reinforcement different than the chopped strand fiber bundles selected from the group consisting of a continuous fiber mat, needled fiber mat, continuous glass web, chopped carbon fibers, chopped aramid fibers, chopped polymer fibers, milled fibers, and microfibers.

11. The abrasive article of claim 1, wherein the MC comprises at least one curing additive comprising hexamethylene tetramine (HMTA), polybenzoxazole (PBO), paraformaldehyde, melamine-formaldehyde resin, phenols or resorcinol with methylol functionality, multifunctional epoxy, cyanate esters, multifunctional isocyanate or any combination thereof.

12. The abrasive article of claim 1, wherein the MC comprises at least one rubber material, elastomeric material, thermoplastic material or any combination thereof.

13. The abrasive article of claim 1, wherein the NAP comprises at least about 20 vol % chopped strand fiber bundles and not greater than about 40 vol % chopped strand fiber bundles.

14. The abrasive article of claim 1, wherein the chopped strand fiber bundles are coated with a thermoplastic coating having a loss on ignition (LOI) of at least about 2.4 wt %.

15. The abrasive article of claim 1, further comprising a back layer mounted to the abrasive portion, and the back layer comprises discrete elastomeric particles and chopped strand fibers bundles, and at least some of the chopped strand fiber bundles have a length of at least about 6.3 mm.

16. The abrasive article of claim 1, wherein the chopped strand fiber bundles have a primary coating and a secondary coating, and wherein the secondary coating comprises a thermoplastic novolac, phenoxy, polyurethane, or any combination thereof.

17. The abrasive article of claim 1, wherein the MC extends as a matrix throughout a total volume of the NAP, and wherein the chopped strand fiber bundles are dispersed completely throughout the matrix of the MC.

18. The abrasive article of claim 1, wherein the NAP has an axial thickness of not less than about 30% of an overall axial thickness of the abrasive article.

19. The abrasive article of claim 1, wherein the MC is at least one of a bulk molding compound (BMC) and a sheet molding compound (SMC).

20. The abrasive article of claim 1, wherein the abrasive article does not comprise a continuous glass web reinforcement.

* * * * *